US009091420B2

(12) United States Patent
Woodgate et al.

(10) Patent No.: US 9,091,420 B2
(45) Date of Patent: Jul. 28, 2015

(54) ILLUMINATION APPARATUS

(75) Inventors: Graham John Woodgate, Henley-on-Thames (GB); Jonathan Harrold, Upper Heyford (GB)

(73) Assignee: OPTOVATE LIMITED, Oxfordshire (GB)

( * ) Notice: Subject to any disclaimer, the term of this patent is extended or adjusted under 35 U.S.C. 154(b) by 250 days.

(21) Appl. No.: 13/638,434

(22) PCT Filed: Mar. 29, 2011

(86) PCT No.: PCT/GB2011/000471

§ 371 (c)(1),
(2), (4) Date: Dec. 21, 2012

(87) PCT Pub. No.: WO2011/121283

PCT Pub. Date: Oct. 6, 2011

(65) Prior Publication Data

US 2013/0107525 A1 May 2, 2013

(30) Foreign Application Priority Data

Mar. 30, 2010 (GB) ..... 1005309.8

(51) Int. Cl.
*F21S 4/00* (2006.01)
*F21V 21/00* (2006.01)
(Continued)

(52) U.S. Cl.
CPC ..... *F21V 29/004* (2013.01); *F21K 9/00* (2013.01); *F21V 5/007* (2013.01); *F21V 7/0083* (2013.01);
(Continued)

(58) Field of Classification Search
CPC ..... F21V 29/004; F21V 29/20; F21V 29/22; F21V 29/2206; F21V 29/2212; F21V 29/2262; F21V 29/225; F21V 5/007; F21V 7/0083; F21V 13/04; F21V 13/12; F21K 9/00; F21Y 2105/001
USPC ..... 362/249.02, 294, 307–309, 311.02, 362/311.11, 327, 800
See application file for complete search history.

(56) References Cited

U.S. PATENT DOCUMENTS 6,547,423 B2 4/2003 Marshall et al.
8,128,263 B2 3/2012 Higuchi et al.
(Continued)

FOREIGN PATENT DOCUMENTS

CN 201259193 Y 6/2009
WO 2008021082 1 A1 2/2008
WO 2011121283 A1 10/2011

OTHER PUBLICATIONS

UKIPO, British Search Report for Application No. GB 1005309.8, dated Apr. 20, 2010.
(Continued)

*Primary Examiner* — Jason Moon Han
(74) *Attorney, Agent, or Firm* — Ingrassia Fisher & Lorenz, P.C.

(57) ABSTRACT

An illumination apparatus, a method of manufacture of the same and a heat sink apparatus for use in said illumination apparatus in which an array of optical elements directs light from an array of light emitting elements through a heat dissipating structure to achieve a thin and efficient light source that provides directional illumination with efficient dissipation of generated heat into the illuminated environment.

18 Claims, 10 Drawing Sheets

(51) Int. Cl.

| | |
|---|---|
| ***F21V 29/00*** | (2015.01) |
| ***F21K 99/00*** | (2010.01) |
| ***F21V 5/00*** | (2015.01) |
| ***F21V 7/00*** | (2006.01) |
| ***F21V 13/04*** | (2006.01) |
| ***F21V 13/12*** | (2006.01) |
| ***F21V 29/02*** | (2006.01) |
| *F21Y 101/02* | (2006.01) |
| *F21Y 105/00* | (2006.01) |

(52) U.S. Cl.

CPC ..... *F21V 13/04* (2013.01); *F21V 13/12* (2013.01); *F21V 29/027* (2013.01); *F21V 29/225* (2013.01); *F21V 29/2206* (2013.01); *F21V 29/2262* (2013.01); *F21V 29/26* (2013.01); *F21V 29/2218* (2013.01); *F21Y 2101/02* (2013.01); *F21Y 2105/001* (2013.01); *Y10S 362/80* (2013.01)

USPC ..... 362/249.02; 362/294; 362/311.02; 362/327; 362/800

(56) References Cited

U.S. PATENT DOCUMENTS

| | | | |
|---|---|---|---|
| 8,177,386 | B2 | 5/2012 | Boyer et al. |
| 2007/0177392 | A1 | 8/2007 | Grigorik |
| 2009/0161382 | A1 | 6/2009 | Eberhardt et al. |
| 2009/0231851 | A1 | 9/2009 | Lai |
| 2010/0073956 | A1 | 3/2010 | Chen |
| 2011/0180819 | A1 | 7/2011 | Van Elmpt et al. |

OTHER PUBLICATIONS

ISA European Patent Office, International Search Report for Application No. PCT/GB2011/000471, dated Jun. 29, 2011.

EPO, Examination Report for Application No. EP11713020.3, dated Jan. 22, 2015.

ILLUMINATION APPARATUS

CROSS REFERENCE TO RELATED APPLICATIONS

This application is a U.S. National-Stage entry under 35 U.S.C. §371 based on International Application No. PCT/GB2011/000471, filed Mar. 29, 2011, which was published under PCT Article 21(2) and which claims priority to Great Britain Application No. 1005309.8, filed Mar. 30, 2010, which are all hereby incorporated in their entirety by reference.

TECHNICAL FIELD

The present invention relates to an illumination apparatus; a heat sink apparatus for use in said illumination apparatus and a method for fabrication of the illumination apparatus. Such an apparatus may be used for domestic or professional lighting, and for general illumination purposes.

BACKGROUND

Incandescent light sources are low cost but have low efficiency, and are relatively large requiring large light fittings. Fluorescent lamps in which a gas discharge generates ultraviolet wavelengths which pumps a fluorescent material to produce visible wavelengths, have improved efficiency compared to incandescent sources, but also have a large physical size. Heat generated by inefficiencies in these lamps is typically radiated into the illuminated environment, such that circulating air is used to cool the lamp and provides some heating benefit to the environment.

Light-emitting diodes (LEDs) formed using semiconductor growth onto monolithic wafers can demonstrate significantly higher levels of efficiency compared to incandescent sources. In this specification LED refers to an unpackaged LED die (chip) extracted directly from a monolithic wafer, i.e. a semiconductor element. This is different from packaged LEDs which have been assembled into a package to facilitate subsequent assembly and may further incorporate optical elements such as a hemispherical structure which increases its size but increases light extraction efficiency. To optimise quantum efficiency, extraction efficiency and lifetime, it is desirable to minimise the junction temperature of the LED. This is typically achieved by positioning a heat dissipating structure (or heatsink) on the rear of the LED to achieve extraction of heat from the chip into an ambient environment. Heat is not typically extracted in the same direction as the light output direction. For recessed devices, the heat dissipating structure does not benefit from natural air flow present in the illuminated environment, reducing its extraction efficiency and increasing cost. Further, the heat may be used to heat walls and/or ceilings rather than the air in the illuminated environment.

In lighting applications, the light from the emitter is directed using a luminaire structure to achieve the light output directional distribution. The angular variation of intensity is termed the directional distribution which in turn produces a light radiation pattern on surfaces in the illuminated environment and is defined by the particular application. Lambertian emitters achieve light to the flood a room. Non-Lambertian, directional light sources use a relatively small source size lamp such as a tungsten halogen type in a reflector and/or reflective tube luminaire, in order to achieve a more directed source. Such lamps efficiently use the light by directing it to areas of importance. These lamps also produce higher levels of visual sparkle, in which the small source provides specular reflection artefacts, giving a more attractive illumination environment. Further, such lights have low glare, in which the off-axis intensity is substantially lower than the on-axis intensity so that the lamp does not appear uncomfortably bright when viewed from most positions.

Directional LED elements can use reflective optics (including total internal reflective optics) or more typically catadioptric (or tulip) optic type reflectors, as described for example in U.S. Pat. No. 6,547,423. Catadioptric elements employ both refraction and reflection, which may be total internal reflection or reflection from metallised surfaces. A known catadioptric optic system is capable of producing a 6 degree cone half angle (to 50% peak intensity) from a 1×1 mm light emitting element, with an optical element with 13 mm final output diameter. The increase in source size arises from conservation of brightness (étendue) reasons. Further, such an optical element will have a thickness of approximately 11 mm, providing a bulky illumination apparatus. Increasing the cone angle will reduce the final device area and thickness, but also produces a less directional source.

SUMMARY

According to a first aspect of the present invention, there is provided an illumination apparatus, comprising a plurality of light emitting elements positioned on a first surface of a substrate and arranged in an array; a plurality of optical elements arranged in an array, the array of optical elements being aligned with the array of light emitting elements; a heat dissipating structure positioned on the first surface of the substrate; the heat dissipating structure thermally coupled to the light emitting elements at least to an extent via the substrate such that in operation heat from the light emitting elements is dissipated by the heat dissipating structure; wherein at least some different portions of the heat dissipating structure are interspersed between at least some different light emitting elements of the array of light emitting elements.

The heat dissipating structure may contribute to the control of the light output directional distribution in cooperation with the array of light emitting elements and respective aligned array of optical elements. The different portions of the heat dissipating structure may be interspersed between different light emitting elements of the array of light emitting elements and contributes to the control of the light output directional distribution. The heat dissipating structure may comprise a thermally conducting plate that is thermally coupled to the first surface of the substrate.

The substrate may comprise a thermally conductive heat spreading layer at the first surface. The thermally conductive heat spreading layer may be positioned on an electrically insulating layer. The heat spreading layer may comprise a material with a thermal conductivity greater than the thermal conductivity of the electrically insulating layer. The heat dissipating structure may comprise a heat dissipating element arranged to transfer heat between the first surface of the substrate and an optical substrate on which the array of optical elements are positioned. The respective heat dissipating structure and heat dissipating elements may comprise a material with a thermal conductivity greater than or equal to 2 W/(m.K), preferably greater or equal to 10 W/(m.K) and more preferably greater than or equal to 100 W/(m.K). Each optical element may have an output aperture of maximum width or diameter less than or equal to 7 mm, preferably less than or equal to 5 mm and more preferably less than or equal to 3 mm; wherein each light-emitting element may have a maximum width or diameter less than or equal to 300 micrometers, preferably less than or equal to 200 micrometers and more preferably less than or equal to 100 micrometers; wherein each optical element may have a maximum height of less than or equal to 5 mm, preferably less than or equal to 3 mm and more preferably less than or equal to 2 mm.

The combined thickness of a light emitting element with an aligned optical element may be approximately equal to the thickness of the thermally conducting plate. The combined thickness of a light emitting element with an aligned optical element may be greater or equal to a third of the thickness of the thermally conducting plate and less than or equal to three times the thickness of the thermally conducting plate.

The heat dissipating structure may comprise a plurality of fins extending away from the plane of the substrate.

The different portions of the heat dissipating structure interspersed between different light emitting elements of the array of light emitting elements may comprise the light emitting elements and optical elements being located within gaps of the heat dissipating structure that extend through the whole thickness of the heat dissipating structure. Different fins may have different heights arranged in combination to contribute to the control of the light output directional distribution in cooperation with the array of light emitting elements and respective aligned array of optical elements. The optical element array may be attached to the heat dissipating structure. The optical element may be provided as a shaped part of the heat dissipating structure. The optical element may be reflective. The fins may be reflective or may be catadioptric. A two-dimensional array of light emitting elements may be positioned between adjacent (consecutive) fins of the heat dissipating structure. A fin's surface profile may be shaped other than parallel planar so as to contribute to the control of the light output directional distribution in cooperation with the array of light emitting elements and respective aligned array of optical elements. A fin's surface profile may be shaped other than parallel planar so as to reduce the output cone angle of the directional output.

The illumination apparatus may further comprise a second heat dissipating structure thermally coupled to the light emitting elements, the second heat dissipating structure positioned to the opposite side of the substrate as the light emitting elements and the first heat dissipating structure. The thermal resistance of the first heat dissipating structure may be less than the thermal resistance of the second heat dissipating structure. The proportion of the heat being dissipated from the light emitting elements by the first heat dissipating structure compared to the second heat dissipating structure may be adjustable. The proportion may be adjustable by means of an adjustable heat dissipating structure position. The proportion may be adjustable by means of one or more forced air flow apparatus of adjustable configuration arranged to provide adjustable air flow across at least one of the first and second heat dissipating structures.

Different parts of the surface of each fin may have different coatings. The different coatings may respectively provide one or more of the following characteristics: (i) diffusion; (ii) specular reflection; (iii) absorption. Surfaces of the heat dissipating structure may further comprise a dust adhesion reducing coating.

The light controlling parts of the heat dissipating structure may be shaped such that in co-operation with the light emitting elements and optical elements the majority of the light that strikes the fins only undergoes one reflection from the fins. A heat transferring fluid may be contained in the fin regions. The light controlling parts of the heat dissipating structure may have tapered sides. The sides may be tapered such that the output cone angle from the fins is greater than the output cone angle from the array of light emitting elements and respective aligned array of optical elements. The sides may be tapered such that the output cone angle from the fins is smaller than the output cone angle from the array of light emitting elements and respective aligned array of optical elements. The different portions of the heat dissipating structure being interspersed between different light emitting elements of the array of light emitting elements may comprise elongate fins oriented with an axis direction parallel to the plane of the first surface. The heat dissipating structure may comprise at least two different orientations of elongate fin.

The illumination apparatus may further comprise a plurality of total internal reflection optical waveguides, respective waveguides being positioned between respective pairs of fins. The total internal reflection optical waveguides may be tapered. The different portions of the heat dissipating structure being interspersed between different light emitting elements of the array of light emitting elements may comprise a two dimensional array of fins arranged in rows and columns and an array of total internal reflection optical waveguides such that the waveguides are positioned only within the rows or only within the columns of the array of fins.

According to a second aspect of the invention, there is provided a heatsink apparatus suitable for thermally coupling to the first surface of a substrate comprising a plurality of light emitting elements positioned on the first surface of the substrate and arranged in an array; comprising an integrated assembly of an optical element array with a heat dissipating structure wherein the optical element array is arranged such that light is capable of passing through the heat dissipating structure by means of the optical elements of the optical element array. The optical elements of the optical element array may be formed in a thermally conducting plate of the heat dissipating structure. The optical elements of the optical element array may be attached to a thermally conducting plate of the heat dissipating structure. The heat dissipating structure may comprise at least one coating to provide one or more of the following characteristics: (i) diffusion; (ii) specular reflection; (iii) absorption; (iv) dust adhesion reduction. The heat dissipating structure may comprise fins extending away from the plane of the thermally conducting plate wherein the fins are elongate, oriented with an axis direction parallel to the plane of the thermally conducting plate.

According to a third aspect of the present invention there is provided a method of manufacturing an illumination apparatus according to the first aspect of the present invention, the method comprising providing an integrated assembly comprising an optical element array integrated with a heat dissipating structure; and thermally coupling the integrated assembly to the first surface of a substrate comprising a plurality of light emitting elements arranged on the first surface of the substrate in an array; wherein the respective light emitting elements are aligned with the respective optical elements. Providing the integrated assembly may comprise providing the optical element array in a monolithic form; and attaching the monolithic optical element array to the heat dissipating structure. Providing the integrated assembly may comprise first providing the heat dissipating structure; and thereafter forming an optical element array in-situ with the heat dissipating structure such that the optical element array is integrated with the heating dissipating structure as part of the forming of the optical element array. The forming of the optical element array may comprise positioning tool parts in relation to the heat dissipating structure and using the tool parts to provide a moulding tool for forming the optical element array. An integrated assembly comprising an optical element array integrated with a first heat dissipating structure may be thermally coupled to a further heat dissipating structure.

According to a fourth aspect of the present invention there is provided an illumination apparatus, comprising a heat dissipating structure comprising a substrate-mounting plate and a plurality of heat dissipating elements, the plurality of heat dissipating elements extending away from a first surface of the substrate-mounting plate; and a plurality of light emitting elements aligned with respective optical elements and arranged on one or more substrates; the one or more substrates being mounted on the first surface of the substrate-mounting plate, such that at least some of the heat dissipating elements are interspersed between at least some of the light emitting elements.

According to a fifth aspect of the present invention there is provided an illumination apparatus, comprising a plurality of light emitting elements aligned with respective optical elements and arranged on a first surface of a substrate; and a heat dissipating structure comprising a plurality of heat dissipating elements, the plurality of heat dissipating elements arranged on, and extending away from, the first surface of the substrate, and thermally coupled to the light emitting elements at least to an extent via the substrate such that in operation heat from the light emitting elements is dissipated by the heat dissipating structure; at least some of the heat dissipating elements being interspersed between at least some of the light emitting elements.

By way of comparison with a known illumination apparatus, the present embodiments advantageously provide a combination of efficient heat dissipating structure and directional optical output device. In particular, a heat dissipating structure is on the same side of the substrate as the light emitting elements and so heat is directed in substantially the same direction as the light. In particular, the heat is extracted into free air which provides for more uniform heat extraction and therefore cooling of the individual light emitting elements. This results in higher light output efficiency and longer LED lifetime. Further, for a given heat extraction requirement, the heat dissipating structure may be of smaller volume, reducing cost and complexity. The illumination apparatus may integrate the function of optical element substrate and heat extraction device. This reduces the number of components in the system and thus reduces complexity and cost of manufacture and assembly. The fins of the heat dissipating structure can be used to provide enhanced optical functions, for example to provide an enhanced beam penumbra, a controlled level of diffusion and a controlled beam shape. The heat dissipating structure can be fabricated using extruded aluminium with elongate heat dissipating fins and can be based on known heat dissipating structure manufacturing processes, reducing device cost. The array of optical elements and light emitting elements can cooperate with the elongate fins to provide a required directionality of optical output. The thermal expansion of the optical element array substrate can be matched to the thermal expansion of the light emitting element substrate. In this manner, the alignment of the light emitting element array and optical element array can be maintained to a high precision across a wide temperature range. This achieves higher beam uniformity, increasing the optical quality of the output beam. The heat produced by the heat dissipating structure can be output into the illuminated environment rather than into a wall or cavity so that the heat can be more efficiently utilised, reducing the heating load on a room from other sources. A second heat dissipating structure may be controlled so that the direction of heat dissipation from the apparatus can be controlled to suit the temperature requirements of the illuminated environment.

BRIEF DESCRIPTION OF THE DRAWINGS

Embodiments of the present invention will now be described, by way of example only, with reference to the accompanying drawings in which.

DETAILED DESCRIPTION

Figure 1A:
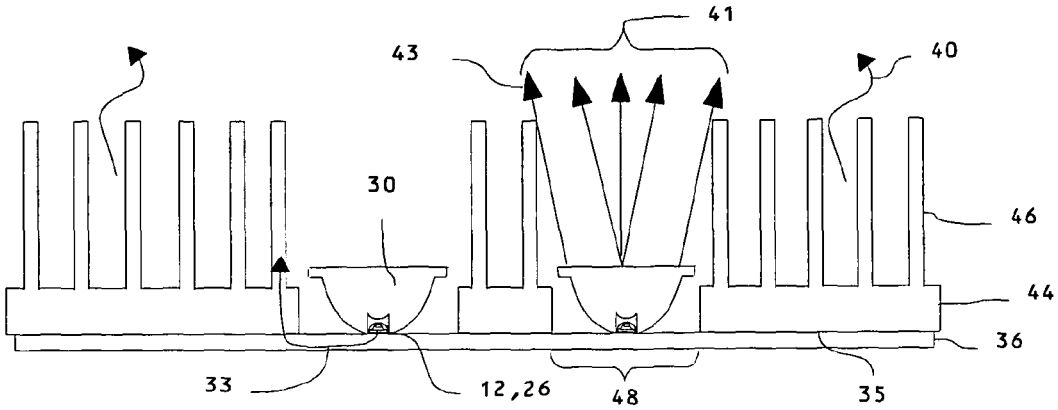
FIG. 1*a* shows in cross section a heat dissipating apparatus arranged to direct light from a light emitting element array through a heat dissipating structure.

A first embodiment of an illumination apparatus comprising optical heat dissipating function is described with reference to FIG. 1*a*. An array of light emitting elements 12 (such as LEDs) and ancillary optics 26 such as hemispherical optical elements (as will be described for example with reference to FIG. 3) is attached to the first surface 35 of a substrate 36 which may comprise for example ceramic carriers and a metallic core PCB arranged to provide electrical connections to the light emitting elements. A heat dissipating structure comprising a thermally conducting plate 44 and heat dissipating fins 46 is attached to the substrate 36 extending away from the plane of the substrate 36. Heat dissipation 40 into the ambient environment occurs from the thermally conducting plate 44 and fins 46. The light emitting elements 12 are thermally coupled to the substrate 36 which in turn is thermally coupled to the heat dissipating structure 44, 46. Heat 33 from the light emitting elements is thus transferred at least partially through the substrate 36 to the heat dissipating structure 44, 46. The structure 44, 46 is thermally coupled into the air (or some other fluid) surrounding the heat dissipating structure 44, 46 to achieve dissipated heat 40. By way of comparison with rear heatsink apparatus when for example mounted into ceiling recesses, advantageously the heat dissipating structure 44, 46 may be in free air so that air flow over the structure may be present and the dissipation efficiency of the device is enhanced. This may reduce the required thickness of the structure 44, 46 for a given heat dissipation capacity and thus reduce its cost. Further the heat 33 extraction efficiency may be increased so that the light emitting elements efficiency may be increased and lifetime extended. When room space heating is required, advantageously the heat extracted from the front heatsink contributes to the heating requirement.

Figure 1B:
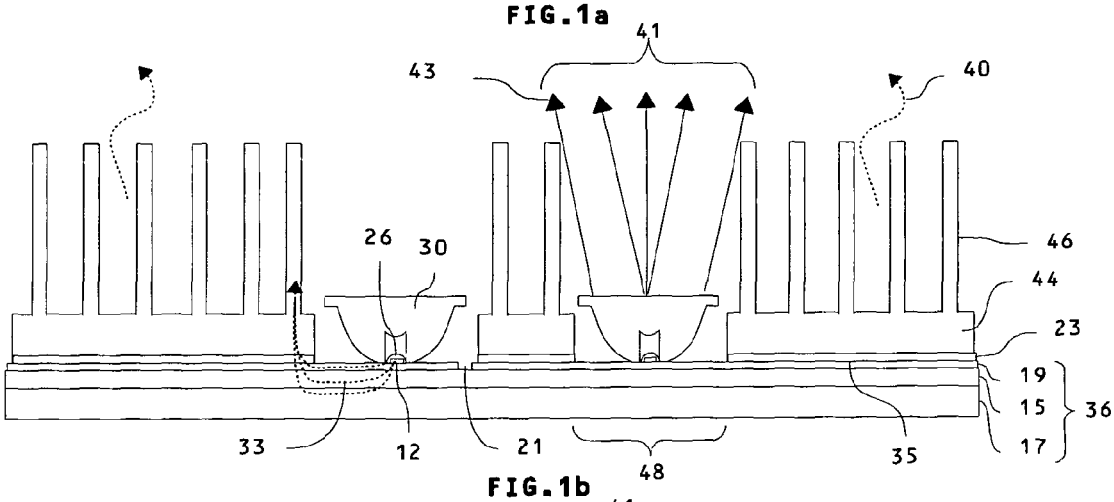
FIG. 1*b* shows the embodiment of FIG. 1*a* in further detail.

As shown in further detail of one embodiment in FIG. 1*b*, the substrate 36 may comprise a thermally conductive heat spreading layer 19, an electrically insulating layer 15 and may further comprise a thermally conductive layer 17 such as a metal layer. Layers 15, 17 and 19 can be considered as part of the substrate 36 and the layer 19 is arranged at the first surface of the substrate 36. The heat spreading layer 19 may comprise a thermally conductive material such as a metal, or silicon. Thus the substrate 36 has in some regions extra layers such as heat spreading layers 19 and insulating layers 15. The surface 35 of the substrate is defined as the top of the substrate, including the extra layers at any given spatial position.

The thermally conductive layer 19 may comprise a material with greater thermal conductivity than the layer 15. For example, the layer 19 may be an aluminium layer of thickness 1 micrometer and thermal conductivity 237 W/(m.K) and the layer 15 may be a glass layer with thickness 50 micrometers and thermal conductivity 1 W/(m.K). Alternatively the layer 19 may comprise a silver loaded epoxy material with thermal conductivity between 1 and 8 W/(m.K) for example. Optionally the heat spreading layer 19 may comprise a material with high thermal conductivity and low electrical conductivity such as a ceramic material such as aluminium nitride, so that a further electrically insulating layer 15 may be omitted.

The heat spreading layer 19 advantageously transfers heat from the light emitting element 12 laterally across the substrate 36, achieving reduced junction temperature of the light emitting elements 12 and increasing efficiency and lifetime.

The substrate 36 may comprise for example a metal core PCB (MCPCB) comprising a thin dielectric layer 15 formed on an aluminium or copper layer 17 with a heat spreading layer 19 positioned at its first surface. Alternatively, the substrate 36 may comprise a glass layer 15 with a metallic heat spreading layer 19 formed at its first surface. The metallic heat spreading layer 19 may comprise for example one or more deposited layers formed by sputtering, electro-deposition, stencil printing of a metallic slurry or other known metal deposition techniques, and may comprise aluminium for example.

The heat spreading layer 19 may comprise regions separated by gaps 21 so that the electrical connection to the light emitting elements 12 may be achieved at least in part by the heat spreading layer 19. Further patterned electrical insulating layers and electrical conducting layers may be provided at the layer 19 to achieve electrical connection to the light emitting element as will be described below.

An electrically insulating layer 23 may be inserted between the substrate 36 and plate 44. The electrical insulating layer may be formed on first surface 35 of the substrate 36 or on the plate 44. Heat 33 from the light emitting elements 12 is thus transferred at least partially through the layers 15, 17, 19 of the substrate 36 to the heat dissipating structure 44, 46.

Further, some portions of the heat dissipating structure 44, 46 are interspersed between at least some different light emitting elements 12 of the array of light emitting elements. This means that heat is extracted more evenly from across the array compared to the case in which the heat dissipating structure is not interspersed. A more uniform junction temperature will be achieved across the array of light emitting elements 12, to improve the efficiency of the array. Further, the lifetime of the array of light emitting element array is increased.

Materials for heat dissipating structures or heat dissipating elements may comprise a material with a thermal conductivity greater than or equal to 2 W/(m.K), preferably greater or equal to 10 W/(m.K) and more preferably greater than or equal to 100 W/(m.K).

An array of apertures 48 is positioned in the thermally conducting plate 44 so that light is transmitted by the heat dissipating structure 44, 46. Optical elements 30 such as catadioptric elements are arranged in alignment with light emitting elements 12 and ancillary optics 26 to achieve a reduction in the solid angle of optical output, defined by the light output directional distribution.

For a substantially Lambertian light output directional distribution of the light emitting elements 12, a non-Lambertian light output directional distribution is thus produced at the output, with ray bundle 41 comprising rays from the centre of the respective optical element 30 and edge rays 43. The heat dissipating elements are arranged so that within a defined solid angle, most of the rays do not strike the fins 46.

Thus an illumination apparatus, comprises a plurality of light emitting elements 12 positioned on a first surface 35 of a substrate 36 and arranged in an array; a plurality of optical elements 30 arranged in an array, the array of optical elements 30 being aligned with the array of light emitting elements 12; a heat dissipating structure 44,46 positioned on the first surface 35 of the substrate 36; the heat dissipating structure thermally coupled to the light emitting elements at least to an extent via the substrate 36 such that in operation heat 33 from the light emitting elements 12 is dissipated by the heat dissipating structure 44, 46; wherein at least some different portions of the heat dissipating structure 44, 46 are interspersed between at least some different light emitting elements 12 of the array of light emitting elements.

The term interspersed can be considered to mean placed at intervals amongst other things, in other words in can be considered to mean spaced between. Interspersing the heat dissipating structure 44, 46 with the light emitting elements 12 advantageously achieves heat dissipation properties in substantially the same direction as the light output direction from the light emitting elements 12 and aligned optical elements 30. Thus heat is distributed into the illuminated environment and can be used to reduce overall energy consumption for the illuminated environment by reducing the heating requirement.

Further, the different portions of the heat dissipating structure 44, 46 being interspersed between different light emitting elements 12 of the array of light emitting elements comprises the light emitting elements 12 and optical elements 30 being located within gaps 48 of the heat dissipating structure 44, 46 that extend through the whole thickness of the heat dissipating structure 44, 46. The heat dissipating structure 44, 46 comprises a thermally conducting plate 44 that is thermally coupled to the first surface 35 of the substrate 36. The substrate 36 may comprise a thermally conductive heat spreading layer 19 at the first surface 35. The thermally conductive heat spreading layer 19 may be positioned on an electrically insulating layer 15. The heat spreading layer 19 may comprise a material with a thermal conductivity greater than the thermal conductivity of the electrically insulating layer 15.

Figure 1C:
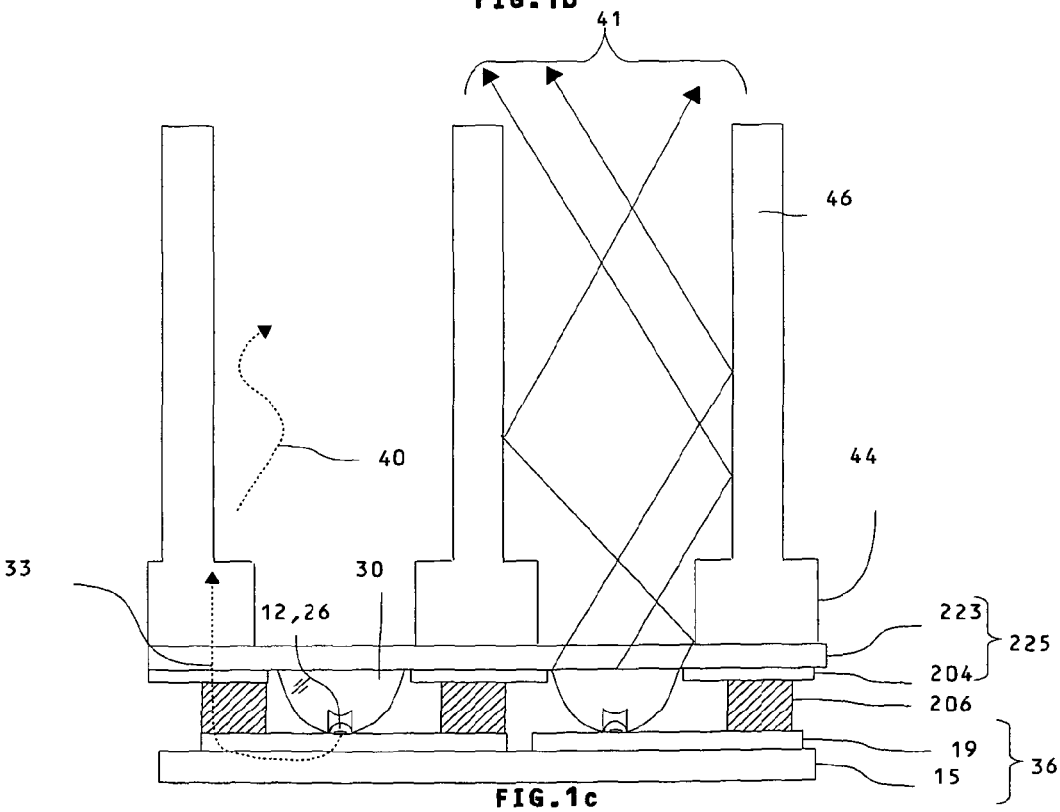
FIG. 1*c* shows in cross section a further arrangement of heat dissipating apparatus.

FIG. 1*c* shows an embodiment wherein an array of light emitting elements 12 and ancillary optics 26 is positioned on the first surface of a substrate 36 comprising a first glass layer 15 and heat spreading layer 19 at the first surface. Optical substrate 225 comprises a glass layer 223 (providing an electrically insulating function) and a heat spreading layer 204 at the surface of substrate 225. An array of catadioptric optical elements 30 is arranged on the surface of substrate 225. The heat spreading layer 204 is provided with apertures through which light from the light emitting elements and optical elements 30 is transmitted. Substrates 225 and 36 are aligned such that the optical elements 30 are aligned with the light emitting elements 12. The heat dissipating structure further comprises heat dissipating elements 206 to efficiently transfer heat 33 to the heat dissipating structure 44,46. Layer 223 may be formed in a material such as glass with a low thermal conductivity, for example less than 2 W/(m.K); however a thin layer, for example less than or equal to 500 microns, preferably less than or equal to 250 microns and more preferably less than or equal to 100 microns may be used to reduce its thermal resistance to heat 33 from the light emitting elements 12. Thus the portion of the substrate 225 between the elements 204 and 44 is arranged to provide part of the heat dissipating structure. Thus the heat dissipating structure 206, 225, 44, 46 is thermally coupled to the light emitting elements 12 at least to an extent via the substrate 36 such that in operation heat from the light emitting elements 12 is dissipated by the heat dissipating structure. At least some different portions of the heat dissipating structure 206, 205, 44, 46 are interspersed between at least some different light emitting elements of the array of light emitting elements 12. Advantageously, such an arrangement achieves mothersheet processing of many elements in parallel while providing effective front surface heat dissipation as will be described below.

In each of the above embodiments a further rear heatsink may be attached to the rear surface (opposite to the first surface 35) of the substrate 36 to further increase heat dissipation from the array of light emitting elements 12.

Thus the heat dissipating structure may further comprise a heat dissipating element 206 arranged to transfer heat between the first surface 35 of the substrate 36, and heat dissipating structure comprising optical substrate 225 on which the array of optical elements 30 are positioned and heat dissipating structure 44,46. The respective heat dissipating structure 44, 46 and heat dissipating elements 206 may comprise a material with a thermal conductivity greater than or equal to 2 W/(m.K), preferably greater or equal to 10 W/(m.K) and more preferably greater than or equal to 100 W/(m.K). The heat dissipating structure comprises a plurality of fins 46 extending away from the plane of the substrate 36.

Figure 2:
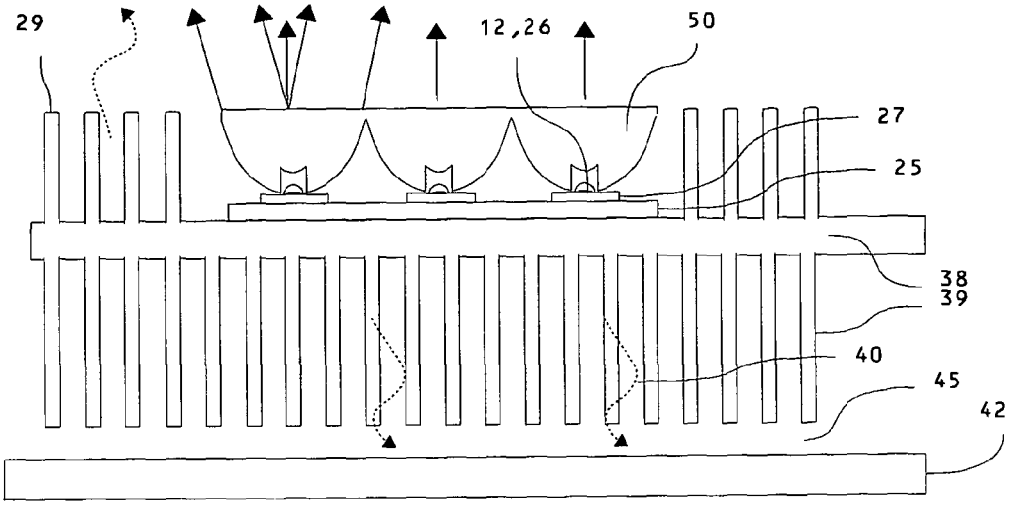
FIG. 2 shows a rear heatsink LED illumination apparatus and heat dissipating structure.

By way of comparison, a rear heatsink directional illumination apparatus and heat dissipating arrangement is shown in FIG. 2 (wherein the heat dissipating structure is attached to the rear surface of the substrate 25). An array of light emitting elements 12 and respective ancillary optics 26 is aligned to an array 50 of optical elements. A heat dissipating structure comprising a thermally conducting plate 38 rear fins 39 and front fins 29 is attached to the rear of substrate 25 so that light does not pass through the thermally conducting plate 38. The heat dissipating structure 39 directs heat 40 to the rear of the device, in the opposite direction to the direction of propagation of light. In many environments, a rear surface such as a wall, ceiling or ceiling cavity is positioned close to the rear of the device, to minimise volume of the device. Thus a small air gap 45 may be positioned between the thermal output and the enclosing environment that increases the ambient temperature of the heatsink and thus disadvantageously increases the junction temperature of the light emitting elements. Such an arrangement may achieve some small heat dissipation from the front surface of the substrate 25. However, the thermal resistance to air of the substrate 25 and array 50 will be significantly higher than the thermal resistance of the heat dissipating structure 38, 39 and thus most of the heat 40 dissipation will occur through the heat dissipating structures 38, 39. The fins 29 of FIG. 2 are positioned outside the edge of the substrate 25. Thus while the fins 29 may be arranged to intersperse the optical elements of the array 50, they do not intersperse the optical elements within the array on the substrate 25. In comparison to the present embodiments, this may degrade the temperature uniformity across the emitting element 12 array.

Each light emitting element 12 and respective ancillary optic 26 is pre-packaged, including heat spreader 27, and then individually mounted using a pick-and-place operation on an MCPCB substrate 25 comprising an electrical insulator and metal layer. By way of comparison with the present embodiments, an LED chip size in the known arrangements of 1×1 mm have significantly higher junction temperatures for a given current density, and thus require higher performance and cost heat spreaders 27, such as those comprising high conductivity ceramics, metal or silicon materials.

Standard 1×1 mm LEDs require a catadioptric optical element typically 10 mm thick. For efficient operation heat dissipating, air must flow over the surface of the fins. However, interspersing fins between 10 mm optics means that the lower 10 mm of the fins is not available for efficient heat transfer. Such an added thickness of fin adds to the cost of the heat dissipating structure and may not substantially improve the heat dissipation performance, and would thus teach away from interspersing the fins. However, in embodiments in which 100 micrometer size light emitting elements 12 are used, the respective optical elements are 1 mm thick. Thus, a small proportion or none of the heat dissipating fins is covered by the optical elements 30 and the whole length of the fin can achieve efficient heat transfer. The heat dissipating fins 44, 46 of FIG. 1 using 1 mm thick optical elements 30 can operate more efficiently than for 10 mm thick optics and have lower cost. Further, the heat transfer path through the front of the substrate 36 can be efficiently achieved by means of heat spreading layer 19. Further, the present embodiments achieve heat dissipation from regions across the substrate 36, advantageously improving heat dissipation uniformity which achieves lower maximum junction temperatures and increasing optical output uniformity The present embodiments have several further advantages compared to the structure of FIG. 2. First, a substantial proportion of the heat extraction can be into the illumination environment rather than in to surrounding materials such as walls or ceilings and can thus be used to heat the environment, reducing the load on the heating system and reducing the overall carbon footprint of the device. Second, the air flow over the heat dissipation structure can be enhanced in a free environment, reducing the size of the heat dissipating structure required. Thus the cost of the heat dissipation apparatus can be decreased. Further, the thickness of the heat dissipation element can be reduced as the optic and thermally conducting plate are combined, providing a flatter light source which can more conveniently be mounted on surfaces such as walls and ceilings without the need for recesses. Alternatively, the greater heat dissipating structure efficiency can be used to reduce light emitting element junction temperature which advantageously achieves a greater lifetime, higher device efficiency. Further the heat dissipation fins can be used to achieve modification of the light output directional distribution, for example by providing a well defined penumbra in the light output directional distribution by clipping high angle rays.

Figure 3:
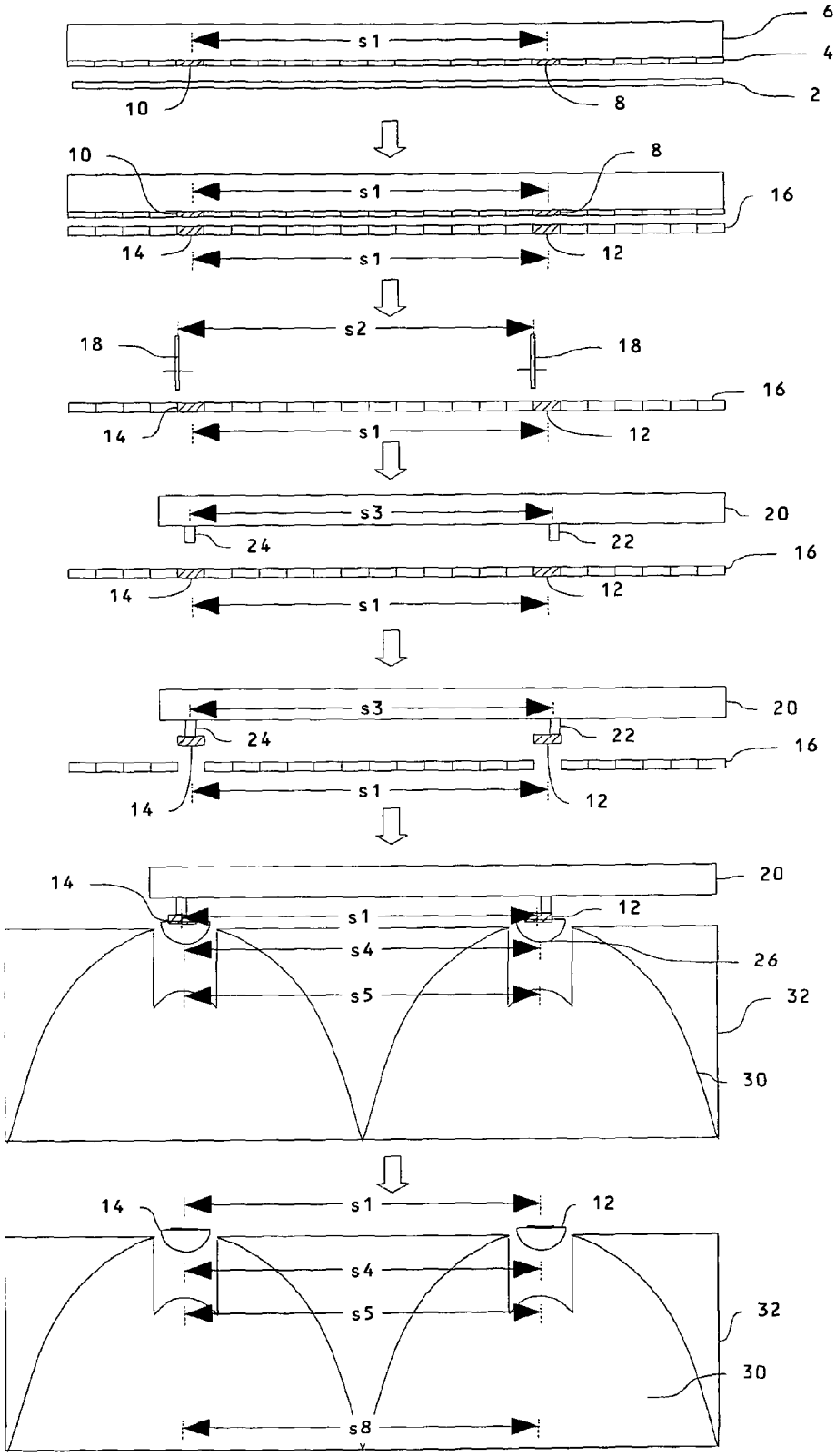
FIG. 3 shows a method to form an illumination apparatus.

Conventional 1×1 mm LED light emitting elements and light directing elements have a catadioptric optical element 30 thickness of approximately 10 mm. Such an arrangement means that the optic is significantly deeper than the thickness of a typical thermally conducting plate 44. A method to advantageously form a microscopic illumination apparatus is disclosed in PCT/GB2009/002340 and is shown in FIG. 3. In a first step at least one mask 4 mounted on a substrate 6 is used to illuminate a monolithic light-emitting element wafer 2. For the purposes of the present specification, the term monolithic refers to consisting of one piece; solid or unbroken. In a second processing step, an array 16 of light-emitting elements is formed in the monolithic wafer 2. Each element has a position and orientation defined by the mask 4. The mask is composed of an array of regions, each region defining the structure of at least one layer of an LED chip. Regions 8 and 10 represent first and second LED chips and have separation s1 as shown. During exposure through the mask onto the wafer 2, elements 12 and 14 are formed from regions 8 and 10 of the mask. The separation s1 of the elements 12, 14 is substantially the same as the separation of the mask regions 8, 10 and the orientation of the elements 12, 14 is the same as the orientation of the respective mask regions 8, 10. The integrity of separation s1 and orientation of elements 12, 14 is preserved through the subsequent processing steps. Multiple masks may be used to photolithographically form the complete LED structure in the manner described, each with regions with the separation s1. Alternatively, the LED chips may be formed by means of nanoimprint lithography or other known lithography method. Such processes preserve a separation and orientations of elements 12 and 14. In a third step, the array 16 of light-emitting elements is cut by means of a cutting device 18, which may for example be a scribe, cutting wheel, laser or saw. The separation s2 of the cut lines for a respective edge of elements 12, 14 would ideally be the same as the separation sl. However, in practice such a precise separation is very difficult to achieve. In a fourth step, a tool 20 has fingers 22, 24 with separation s3 is aligned to the array 16. The separation s3, orientation and placement of the fingers would ideally be the same as the separation s1, orientation and placement of the light-emitting elements of the array. However, in practice such a separation, orientation and placement may be difficult to achieve. Advantageously the separation s3 is not required to be identical to the separation s1, or the orientation and placement of the fingers to be identical to the orientation and placement of the light-emitting elements 12, 14. In a fifth step the fingers 22, 24 are attached to the elements 12, 14 respectively and used to extract the elements from the array 16. It can be seen that while the separation s3 and orientation of the fingers 22,24 is not identical to the separation s1 and orientation of the elements 12, 14, the integrity of the separation s1 and orientation of the elements 12 and 14 is nevertheless preserved in this extraction step. In a sixth step, the tool 20 with elements 12 and 14 attached is aligned to an array 32 of microscopic optical elements 30 comprising catadioptric optical elements 30. The array 32 may be monolithic and the relative spatial positions of the optical elements 30 may be provided when the optical elements 30 are formed. The elements 12, 14 are further attached to an optional array of refractive ancillary optics 26 comprising hemispherical refractive structures arranged to achieve improved light extraction from the light emitting elements, but not providing substantial change in the light output directional distribution (so that the solid angle of the light output directional distribution is substantially the same as the solid angle of the light output directional distribution of the light emitting elements). Thus the non-monolithic light-emitting element array and the optical element array are aligned such that a given optical element is aligned with a respective light-emitting element. The light-emitting element is positioned substantially in the input aperture (entrance pupil) of the respective optical element. In a seventh step, the elements 12, 14 are attached to the array 32 of optical elements 30 and array of ancillary optics 26.

The optical elements 30 of the optical element array 32 each have an output aperture (exit pupil) greater in area than the area of the respective light-emitting element in the input aperture such that the respective optical element 30 of the array of optical elements 12 that is aligned with a light-emitting element 12 of the non-monolithic light-emitting element array directs light emitted by the light-emitting element into a smaller solid angle than that at which the light is emitted by the light-emitting element.

The optical elements 32, 34 have input apertures with a separation s5. Separation s1 of the light-emitting elements 12, 14 and separation s5 of the input apertures of optical elements 32, 34 will typically be substantially the same. Further, the separation s8 of the output apertures of elements 34, 32 is substantially the same as separations s1 and s5, so that the cone of the light output directional distribution from elements 12, 32 is substantially parallel to the cone of the light output directional distribution from elements 14, 34. Further, the step of selectively removing a plurality of light-emitting elements from the monolithic array in a manner that preserves the relative spatial position of the selectively removed light-emitting elements may further comprise removing the plurality of light-emitting elements from the monolithic array in a manner that preserves the relative orientation of the selectively removed light-emitting elements. Advantageously this achieves a highly uniform directional beam as the illumination profile of the light output directional distribution can be substantially identical for respective elements with the same orientation of light-emitting elements.

The separation of the individual optical elements 30 in the array 32 can advantageously be preserved across the width of the optical element 30 array. The alignment is therefore preserved for all light-emitting elements 12 with all optical elements 30 of the microscopic optical element array while providing the desired directionality properties of the array with a highly uniform light output directional distribution for large numbers of light-emitting elements 12. Further, the elements 12 may be aligned to an array of refractive ancillary optics 26, such as hemispherical structures with separation s4, typically similar to the separation s5 so as to achieve efficient light extraction into air from the light-emitting elements 12, 14. Further, the thickness of the optical element 30 can be reduced to approximately 1 mm if the light emitting elements 12 have a width of 100 microns. Such a thickness advantageously is similar to the thickness of a typical plate 44. Thus the optical element 30 does not need to fall in the gaps between the fins 46, and the air flow over the fins is thus improved, increasing the cooling efficiency.

Figure 4:
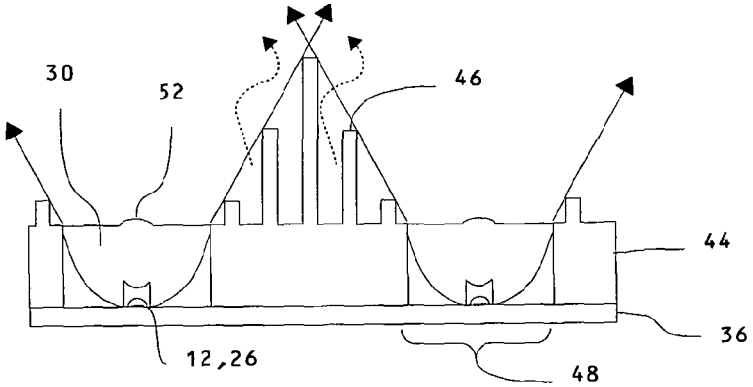
FIG. 4 shows a further heat dissipating structure arranged to control light from a light emitting element array through a heat dissipating structure.

In combination with the heat dissipation structures of the present embodiments, the microscopic illumination elements that may be formed by this process may be incorporated within apertures 48 in the thermally conducting plate 44 as shown in FIG. 4 so that the heat dissipating structure 44, 46 intersperses the light emitting elements 12. The thickness of the light emitting element array and aligned catadioptric optical element array 30 may be similar as the thermally conducting plate 44, so that the optic may be attached to the thermally conducting plate 44. The combined thickness of a light emitting element 12 with an aligned optical element 30 may be approximately equal to the thickness of the thermally conducting plate 44; may be greater or equal to a third of the thickness of the thermally conducting plate 44 and less than or equal to three times the thickness of the thermally conducting plate.

Such an arrangement has significant cost reduction benefits due to the combination of a high tolerance optical element array fabrication technique together with a lower tolerance aperture 48 fabrication technique for the heat dissipation element. Thus each optical element 30 may have an output aperture of maximum width or diameter less than or equal to 7 mm, preferably less than 5 mm and more preferably less than 3 mm; wherein each light-emitting element 12 may have a maximum width or diameter less than or equal to 300 micrometers, preferably less than or equal to 200 micrometers and more preferably less than or equal to 100 micrometers. wherein each optical element 30 may have a maximum height of less than or equal to 5 mm, preferably less than or equal to 3 mm and more preferably less than or equal to 2 mm.

FIG. 4 shows that the front surface of the optical elements 30 may have additional light directing features such as lens 52 to modify the light output directional distribution. In this embodiment, the height of the fins 46 may be adjusted so as to achieve an increased divergence of the light output directional distribution compared to the embodiment of FIG. 1 a. Thus the tops of the fins may form an angle with respect to the light emitting element array and aligned optical element array. Different fins 46 have different heights arranged in combination to contribute to the control of the light output directional distribution in cooperation with the array of light emitting elements and respective aligned array of optical elements. Advantageously, this further achieves some clipping of high angle light from the optical element 30 light output directional distribution, providing a sharper beam penumbra than from the optical element light output directional distribution in combination with the light emitting element 12.

The heat dissipating structure 44, 46 thus contributes to the control of the light output directional distribution in cooperation with the array of light emitting elements 12 and respective aligned array of optical elements 30. Further, the different portions of the heat dissipating structure 44, 46 being interspersed between different light emitting elements 12 of the array of light emitting elements contributes to the control of the light output directional distribution.

Further, the microscopic elements that are fabricated using the method of FIG. 3 have a small output aperture diameter (for example 2 mm in the case of 100 micrometer width light emitting elements 12), so the distance from the light emitting element through the substrate 36, to the thermally conducting plate 44 is small, reducing the thermal resistance. Advantageously, such an arrangement has a lower junction temperature, higher efficiency and longer lifetime than microscopic elements in such an arrangement in which the distance through the substrate is greater and the thermal resistance higher.

Figure 5:
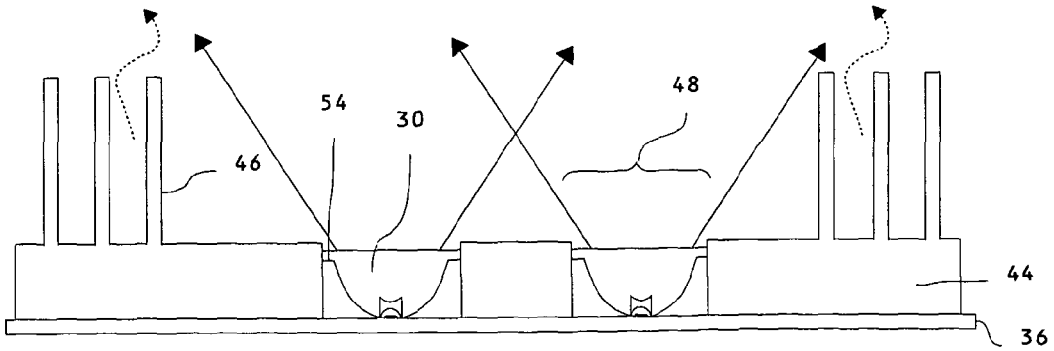
FIG. 5 shows a further heat dissipating structure arranged to direct light from a light emitting element array through a heat dissipating structure.

As shown in FIG. 5, the fins 46 may be positioned at the edge of the thermally conducting plate 44 while the central area has no fins, so as to reduce beam clipping by the fins. Additionally, the optical elements 30 may be attached to the heat dissipating structure by means for example of an attachment means 54 (such as an adhesive) to the thermally conducting plate 44. Advantageously, the thermally conducting plate 44 may form a monolithic substrate for the optical element array (comprising optical elements 30). In particular, if the thermal expansion of the thermally conducting plate 44 is the same as the substrate 36 used to mount the light emitting element array, then temperature changes in the apparatus will cause the separation of the light emitting elements to vary in the same manner as the separation of the optical elements 30. Thus, the alignment of the optical elements is maintained, and the device may have a high uniformity of light output across the array of elements over a wide temperature range.

Figure 6A:
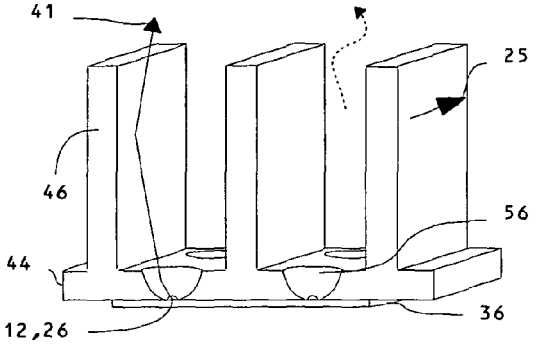
FIG. 6*a* shows optical elements formed in the thermally conducting plate and a layout of heat dissipating fins.
Figure 6B:
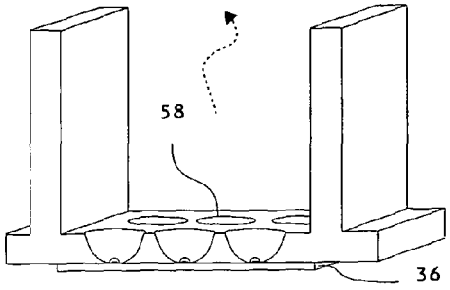
FIG. 6*b* shows optical elements formed in the thermally conducting plate and a further layout of heat dissipating fins.

In FIG. 6*a*, an array of optical elements 56 is provided as a shaped part of the heat dissipating structure and comprises reflective surfaces formed in the thermally conducting plate 44. Light from the light emitting element 12 and ancillary optics 26 is directed towards the fins 46 by the optical elements 56. Light ray 41 is reflected on one of the walls of the fins 46. The fins and optical elements 56 may be surface coated to improve device efficiency as described below. FIG. 6*b* shows a modified form of FIG. 6*a* in which an array 58 of optical elements is formed between adjacent fins. Such a microscopic array may be achieved by the method of FIG. 3 for example in which the thermally conducting plate 44 forms a monolithic optical element array. Thus the optical element 56 is provided as a shaped part of the heat dissipating structure 44, 46.

Figure 6C:
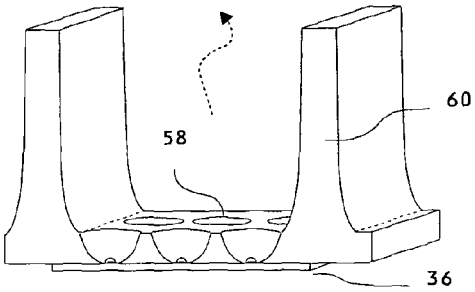
FIG. 6*c* shows optical elements formed in the thermally conducting plate and a further layout of heat dissipating fins.

Advantageously, such an arrangement achieves the result that the elements can be positioned within the thermally conducting plate, so increasing the amount of air flow over the fins of the heat dissipating structure and increasing cooling efficiency. Further, the separation of the fins can be increased compared to the apparatus of FIG. 6*a*, to increase the output optical efficiency and heat extraction efficiency by means of improved air flow over the fins. In FIG. 6*c*, the profile of the walls of the fins 60 is modified so as to achieve an additional light directing function, reducing the light output directional distribution cone angle of the output. Thus the surface profile of a fin 46 may be shaped other than parallel planar so as to contribute to the control of the light output directional distribution in cooperation with the array of light emitting elements 12 and respective aligned array of optical elements 58.

Figure 6D:
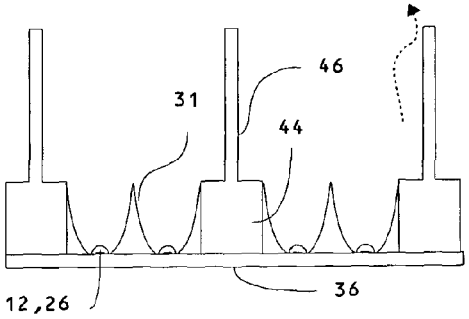
FIG. 6*d* shows an array of light emitting elements aligned with an array of reflective optical elements with portions of a heat dissipating structure interspersed therebetween.

FIG. 6*d* shows a further embodiment in which the optical elements 31 comprise reflective structures such as pressed aluminium that are attached to the thermally conducting plate 44 rather than formed within the plate 44. The optical elements 31 may have a lower thermal resistance than the catadioptric optical elements 30 and may achieve some thermal dissipation; however the thermal resistance of the heat dissipation structure 44, 46 is typically much lower and thus will achieve the majority of the heat dissipation function.

Figure 6E:
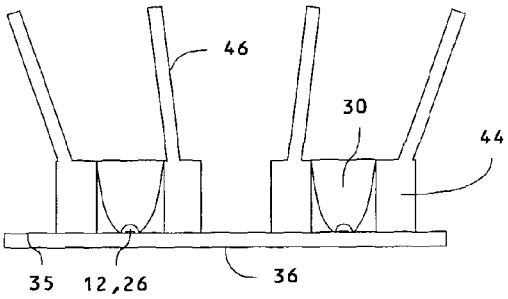
FIG. 6*e* shows an array of light emitting elements aligned with an array of optical elements and a heat dissipating structure with inclined elongate fins.

FIG. 6*e* shows in cross section a further embodiment in which elongate fins 46, are oriented with an axis direction into the plane of the paper and parallel to the plane of the thermally conducting plate 44. The fins extend away from the first surface 35 of the substrate 36 and are inclined with a tilt away from the normal to the surface 35. The angle of tilt may vary across the surface of the illumination apparatus. Such a heat dissipating structure 44, 46 may conveniently be formed by extrusion. Such an arrangement can advantageously be used to achieve enhanced heat dissipation characteristics and a modified illumination structure.

Figure 7:
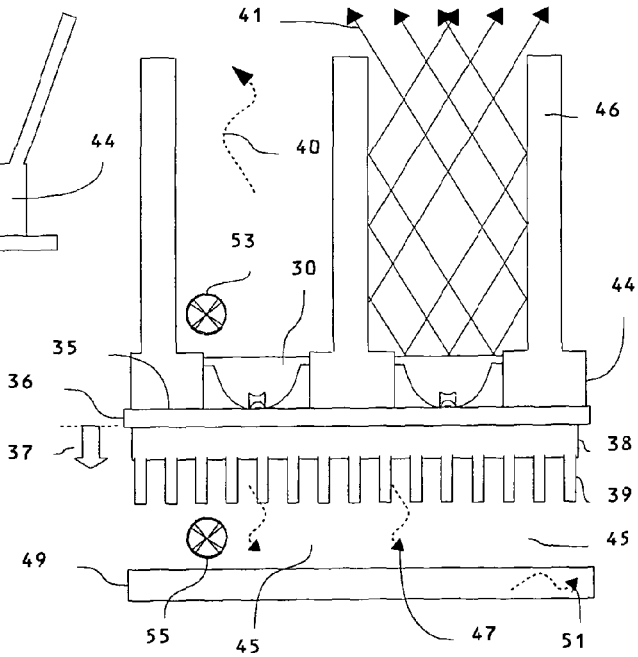
FIG. 7 shows a further heat dissipating structure arranged to direct light from a light emitting element array through a heat dissipating structure.

FIG. 7 shows an arrangement in which a rear heat dissipating structure 38, 39 is incorporated in addition to the front heat dissipating structure of the present embodiments to advantageously increase the amount of heat dissipation from the device. Thus a second heat dissipating structure 38, 39 is provided, thermally coupled to the light emitting elements 12, the second heat dissipating structure 38, 39 positioned to the opposite side of the substrate 36 as the light emitting elements 12 and the first heat dissipating structure 44, 46. The thermal resistance of the first heat dissipating structure may be less than the thermal resistance of the second heat dissipating structure. Advantageously, such an arrangement achieves higher heat dissipation into the illuminated environment, increasing the efficiency of the heat dissipating structure due to greater air current flow. Additional heat dissipation is added to the rear of the substrate 36 advantageously reduces the thickness of the first heat dissipating structure 44, 46, and increases its optical efficiency by reducing the number of reflections of light rays at the surface of the fins 46.

The plurality of (light) reflective fins 46 is elongate in a first direction which is orthogonal to the normal of the first surface 35 of the substrate 36. In particular, the different portions of the heat dissipating structure being interspersed between different light emitting elements of the array of light emitting elements comprises elongate fins oriented with an elongate axis direction 25 parallel to the plane of the first surface 35. Although the fins 46 are elongate and have a reflective optical function, such an arrangement can advantageously achieve a substantially symmetric light output directional distribution. This is because the shape of the optical elements 30 achieves optical power in the first direction (parallel to the direction of elongation of the fins) and in a second direction different to the first direction and orthogonal to the normal of the first surface 35 while the fins do not substantially change this directional distribution.

Such an arrangement may advantageously further modify the heat output direction of the apparatus by providing the proportion of the heat being dissipated from the light emitting elements by the first heat dissipating structure 44, 46 compared to the second heat dissipating structure 38, 39 to be adjustable. The proportion may be adjustable by means of an adjustable heat dissipating structure 38, 39 position. The proportion may be adjustable by means of one or more forced air flow apparatus 53, 55 arranged to provide adjustable air flow across at least one of the first heat dissipating structure 44, 46 and second heat dissipating structure 38,39.

For example, in winter time when room heating is desirable, the rear elements 38, 39 may be mechanically detached as shown by arrow 37 from the substrate 36 so that heat dissipation is mainly into the illuminated environment. In summertime when air conditioning may be preferable, the elements 38, 39 may be attached so that the degree of heat 40 output into the room is reduced and the heat 47 is directed into cavities 45 within the building. For example an adjustable heat pipe 49 (such as by means of a mechanically adjustable heat pipe position) may be used to direct heat 51 away from the environment so that the load on air conditioning is reduced. Thus the proportion of heat is adjustable by means of an adjustable position heat transmitting element 38, 39, 49. Alternatively, a fan 53 may be configured with the thermally conducting plate 44 and fins 46 so that air is blown over the front heat dissipating elements 44, 46 to increase room temperature. Alternatively the proportion is adjustable by means of one or more forced air flow apparatus of adjustable configuration. For example a fan 55 (or other forced air flow apparatus such as a piezo controlled membrane) may be used to further reduce junction temperature, or to reduce load on air conditioning systems by removing heat into the building fabric. In this manner, the light source may be integrated with the air temperature management system to improve overall system heat efficiency. In this case, the thermal resistance of the second heat dissipating structure 38, 39 may be made lower than that of the first heat dissipating structure 44, 46.

Figure 8A:
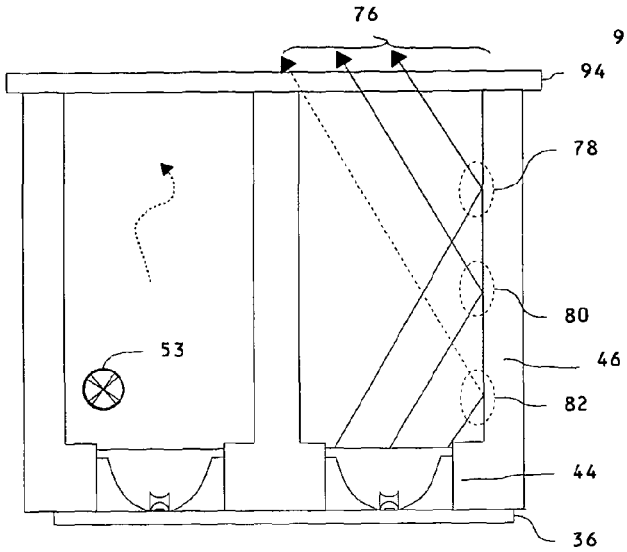
FIG. 8*a* shows the operation of a light transmitting heat dissipating element with coated heat dissipating fins
Figure 8B:
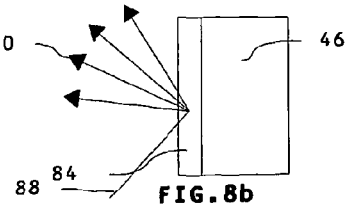
FIG. 8*b* shows one surface coating to enhance the optical function of heat dissipating fins.
Figure 8C:
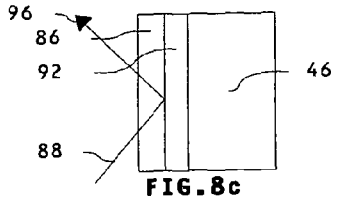
FIG. 8*c* shows a further surface coating to enhance the optical function of heat dissipating fins.
Figure 8D:
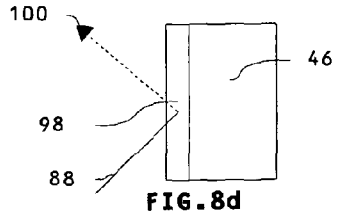
FIG. 8*d* shows a further surface coating to enhance the optical function of heat dissipating fins.

For reduced junction temperatures, it is desirable to increase the length of the fins 46 of the heat dissipating structure to reduce the thermal resistance of the heat dissipation structure 44, 46. Such an arrangement may reduce the cone angle of light that efficiently exits the device due to multiple reflections from the fins. The surfaces of the fins may thus be coated as shown in FIG. 8*a* to achieve additional or enhanced optical function from the fins. For a light output directional distribution ray bundle 76, different parts of the ray output bundle may strike different regions 78, 80 and 82 of the walls of the fins 46. FIG. 8*b* shows a first portion 78 which may comprise a diffusing material 84 coated onto the fin 46. Thus incident ray 88 is output as a ray bundle 90, distributing the light over a modified optical cone. Such an arrangement may advantageously achieve a wide cone from a deep heat dissipating structure. FIG. 8*c* shows a reflective portion of the fin, in which a metallic coating 92 is applied to the fin surface so as to achieve a specular reflection of ray 88 to ray 96. The surfaces of the heat dissipating structure may further comprise a dust adhesion reducing coating such as a transparent low surface energy coating 86 such as a thin fluorinated film (as well as to other coatings of FIGS. 8*b* and 8*d*). This will reduce the adhesion of airborne dust and other contaminants to the surface. Thus the reflectivity of the surface in an ambient environment can be maintained. Alternatively, a window 94 may be applied to the front of the heat dissipating structure with optionally a fan 53 used to blow air (which may be filtered) through the device. FIG. 8*d* shows a region in which an absorptive coating 98 is applied, so that incident rays 88 are absorbed with reduced power in output rays 100 so as to achieve a desired beam output penumbra. Thus different parts of the surface of each fin 46 may have different coatings. The different coatings 84, 92, 98 may respectively achieve diffusion, specular reflection and absorption. The absorption parts may further comprise light absorbing surface relief such as a groove structure to provide a further reduction in visibility of fin surface, for example to advantageously achieve an improved penumbra and reduced glare for off axis viewing positions.

If the optical elements are thinner than the plate 44 then the coatings applied to the fins 44 may be further applied to the walls of the aperture 48 in the plate 44 to advantageously provide further light management through the plate 44.

It is desirable to reduce the number of reflections at the heat dissipating fins. First, reflections at a metal surface have a finite loss and so reduce the output efficiency of the device. Further, any dust that falls on the heat dissipating structure surface will degrade the reflectivity further and thus reduce device lifetime. Further, the reflection of a coating may have a spectral characteristic, which changes the colour of the output compared to the light that passes directly through the heat dissipating structure without undergoing any reflection. If just a single reflection occurs through the device, then advantageously the colour change can be reduced. In other words, the light controlling parts of the heat dissipating structure 44, 46 are shaped such that in co-operation with the light emitting elements 12 and optical elements 30 the majority of the light that strikes the fins 46 only undergoes one reflection from the fins 46. Thus the embodiment may be configured to minimise the number of reflections on the fin surfaces. Advantageously the optical elements 30 of the present embodiments can be arranged to direct the light in a small range of angles, so that a small proportion of the rays undergo more than one reflection at the fin surfaces.

Alternatively, the light transmitting cavity comprising the walls of the heat dissipating components 44, 46 and window 94 may be filled with a fluid such as an oil or antifreeze so that a heat transferring fluid is contained in the fin regions. The oil may be used to transfer the heat dissipated to an additional heat exchanger. Advantageously such an arrangement achieves a dust free heat dissipation apparatus in which the front window 94 can be conveniently cleaned.

Figure 9:
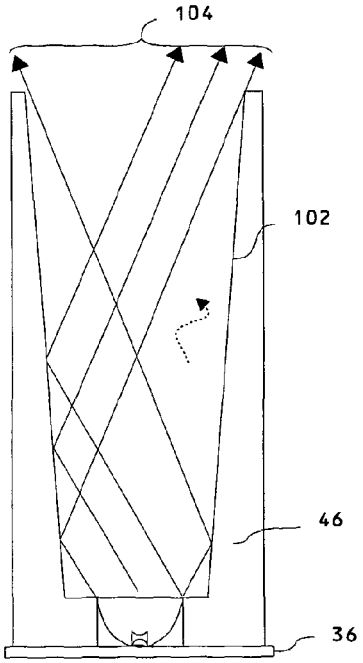
FIG. 9 shows tapered heat dissipating fins with an optical function to decrease the cone angle of the light output directional distribution.
Figure 10:
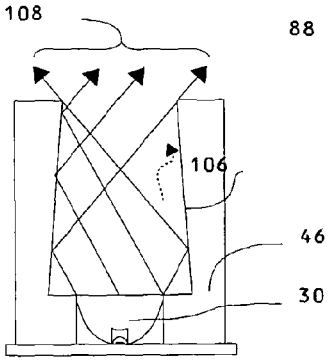
FIG. 10 shows tapered heat dissipating fins with an optical function to increase the cone angle of the light output directional distribution.

The walls of the fins may further have non-parallel sides as illustrated in FIG. 9 in which the walls 102 of the fins 46 are tapered with the output aperture size greater than the input aperture size. The light controlling parts of the heat dissipating structure 44, 46 thus have tapered sides. This serves to reduce the cone angle 104 of the final ray bundle output of the device, for example to achieve increased directionality of the beam for a spot light function. Thus a fin's surface profile may be shaped other than parallel planar so as to reduce the output cone angle of the light output directional distribution. The sides may be tapered such that the output cone angle 104 from the fins 46 is greater than the output cone angle from the array of light emitting elements 12 and respective aligned array of optical elements 30. Advantageously, such an arrangement achieves a thicker heat dissipating structure for a given input cone angle from the optical elements 30 while reducing the number of reflections of rays within the waveguide. FIG. 10 shows alternative tapered fin surfaces 106 in which the output aperture is smaller than the input aperture, so as to increase the cone angle of the light output directional distribution. Thus the sides are tapered such that the output cone angle 108 from the fins is smaller than the output cone angle from the array of light emitting elements and respective aligned array of optical elements. Advantageously in combination with a small light output directional distribution cone angle from the optical element 30, this embodiment achieves a wide output ray bundle cone angle 108 while reducing the number of reflections at the surfaces 106. Thus a fin 46 has a surface profile that is shaped other than parallel planar so as to contribute to the control of the light output directional distribution in cooperation with the array of light emitting elements 12 and respective aligned array of optical elements 30. A fin 46 may have a surface profile shaped other than parallel planar so as to reduce the output cone angle of the directional output 106, 108. The sides of the fins 46 may be tapered such that the output cone angle from the fins is greater than the output cone angle from the array of light emitting elements 12 and respective aligned array of optical elements 30. The sides of the fins 46 may be tapered such that the output cone angle from the fins is smaller than the output cone angle from the array of light emitting elements 12 and respective aligned array of optical elements 30.

Figure 11A:
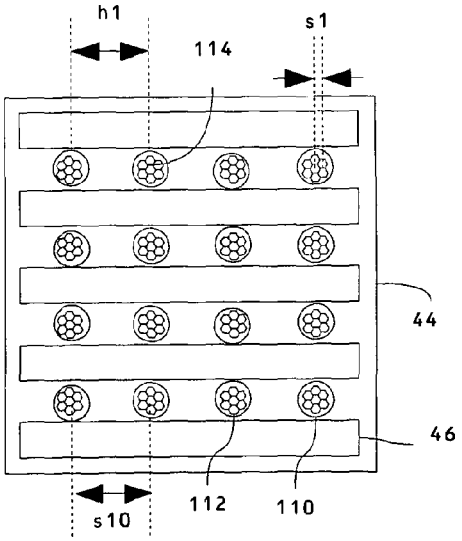
FIG. 11*a* shows in plan view a configuration of optical elements and heat dissipating structure.
Figure 11B:
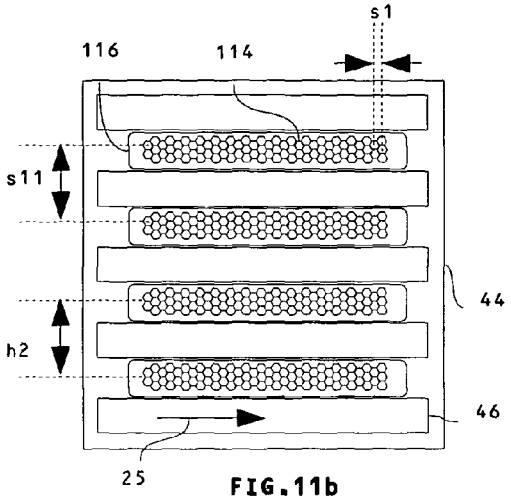
FIG. 11*b* shows in plan view a further configuration of optical elements and heat dissipating structure.

FIG. 11*a* shows in plan view one arrangement of a heat dissipating structure. Thermally conducting plate 44 has heat dissipating fins 46 positioned on its top surface. Apertures 110, 112 are formed in the thermally conducting plate and groups 114 comprising multiple groups of aligned light emitting element 12, hemispherical ancillary optic 26 and optical element 30 are positioned within the respective apertures. The method of FIG. 3 can be used to form a high precision separation s1 within the groups 114 and separation s10 between light emitting elements and optics across respective groups. Thus, the device can have high output uniformity across the array of elements. The apertures 110, 112 however are not required to have an accurate separation hl as the position of the optic is defined by the method to form the light emitting element 12, ancillary optic 26 and optical element 30. Thus a two-dimensional array of light emitting elements 12 is positioned between adjacent (consecutive) fins 46 of the heat dissipating structure 44, 46. Advantageously such arrangement does not require precise formation of apertures within the thermally conducting plate, and thus reduces device cost. FIG. 11*b* shows an alternative embodiment in which slots 116 are formed within the thermally conducting plate and larger arrays of light emitting elements 12, ancillary optics 26 and optical elements 30. Again, the separation s11 between optics in adjacent slots can be preserved to a high precision whereas the separation h2 of the slots is not required to be maintained to high precision, reducing fabrication cost. The different portions of the heat dissipating structure being interspersed between different light emitting elements 12 of the array of light emitting elements comprises elongate fins 46 oriented with an axis direction parallel to the plane of the first surface 35.

Figure 11C:
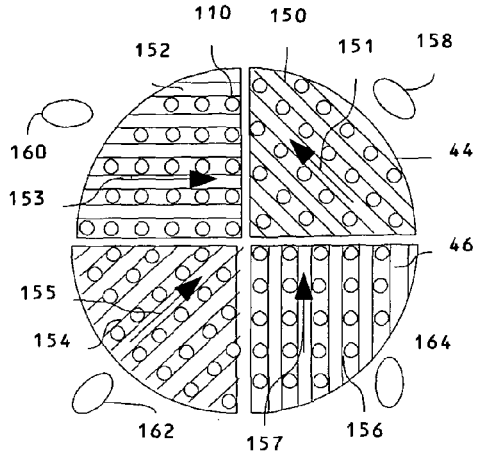
FIG. 11*c* shows in plan view a further configuration of optical elements and heat dissipating structure.

The light that passes through the fins 46 without undergoing any reflection may have a slightly higher intensity and different colour to the light that undergoes a reflection. In order to increase the uniformity of the final output illumination spot, while using elongate structures to increase thermal efficiency and ease of fabrication using extrusion techniques, an embodiment such as shown in FIG. 11*c* may be used. The regions 150, 152, 154, 156 may have different orientations of elongate fin 46 with respective axis directions 151, 153, 157, 159 parallel to the plane of the first substrate and optical elements in apertures 110 across the area of the light emitting element array. The heat dissipating structure thus comprises at least two different orientations of elongate fins 46. The respective output illumination spots from the respective light output directional distributions are represented by loci 158, 160, 162, 164 and add together to give the final output characteristics. Thus the heat dissipating structure may comprises at least two different orientations of elongate fins.

Figure 12:
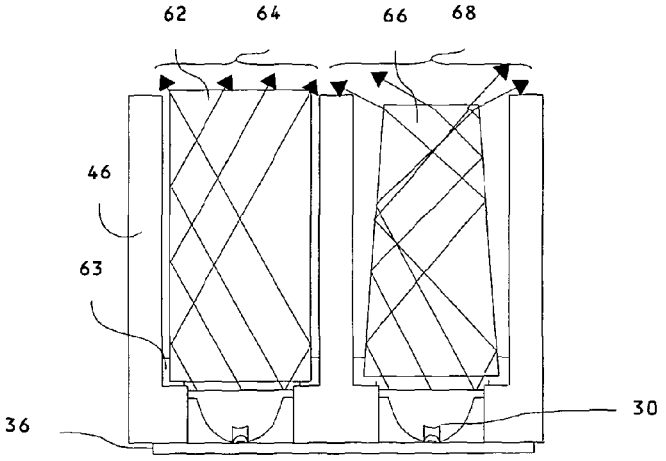
FIG. 12 shows a further heat dissipating structure arranged to direct light from a light emitting element array through a heat dissipating structure using further waveguide elements.

FIG. 12 shows an embodiment to compensate for reflection losses at the walls of the fins 46 by using total internal reflection optical waveguide elements, such as moulded plastics 62 incorporated between the heat dissipating structure fins 46. The apparatus comprises a plurality of total internal reflection optical waveguides, respective waveguides being positioned between respective pairs of fins. In this manner total internal reflection within the waveguides 64 can be used to increase the light efficiency of the devices. Further, tapered waveguides 66 (which can have an output aperture smaller than the input aperture or vice versa depending on the light output directional distribution required and may also have non-linear edge functions) can be used in order to change the cone angle of the output ray bundle 68 compared to the waveguide 62 which produces a ray bundle 64. An adhesive layer 63 may be used to mount the waveguides to the fins 46 and thermally conducting plate 44.

Figure 13:
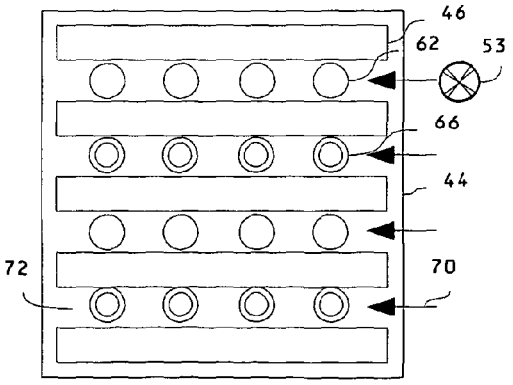
FIG. 13 shows in plan view one arrangement for the structure of FIG. 12.
Figure 14:
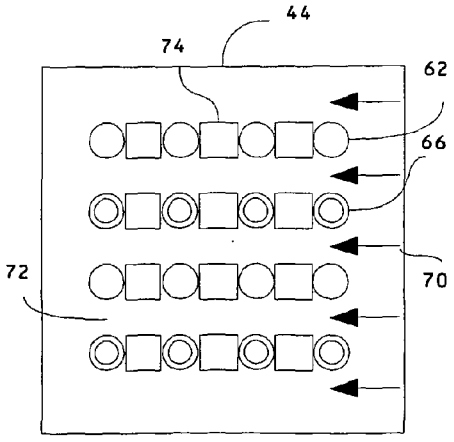
FIG. 14 shows in plan view another arrangement for the structure of FIG. 12.

As shown in FIG. 13, the waveguides may be arranged in the channels 72 of extruded heat dissipating structures; however the waveguides may block the efficient flow 70 of air across the heat dissipating structure, and thus reduce its heat dissipation efficiency. Alternatively, as shown in FIG. 14 the waveguides may be positioned within the fins 74, so as to achieve efficient air flow over the structure. The different portions of the heat dissipating structure being interspersed between different light emitting elements of the array of light emitting elements 12 comprises a two dimensional array of fins 74 arranged in rows and columns and an array of total internal reflection optical waveguides 62, 66 such that the waveguides are positioned only within the rows or only within the columns of the array of fins 74. The plastics used to form the elements 30, 62 and 64 may further comprise high thermal conductivity plastics such as liquid crystal polymer materials. Advantageously, the waveguides may comprise a heat dissipation function as well as optical waveguiding functions.

Figure 15:
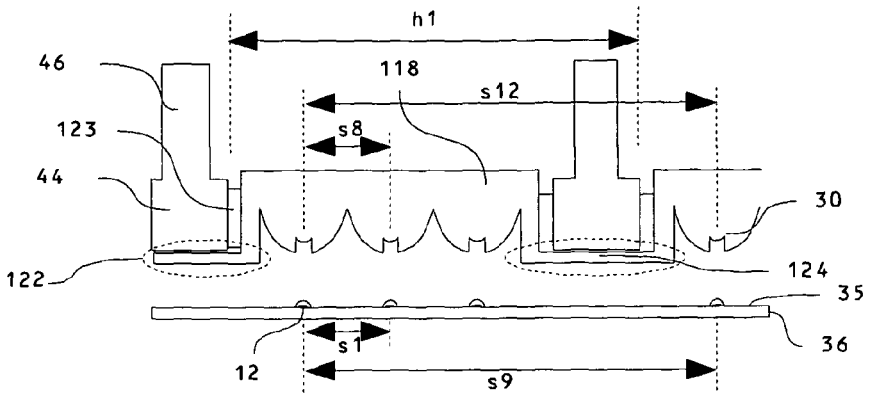
FIG. 15 shows a heat dissipating structure with attached optical elements.

FIG. 15 shows a method to form a heat dissipating structure in which a monolithic optical element array 118 is attached to a heat dissipating structure 44, 46 by means of an adhesive 123. An array of light emitting elements is formed with a separation s1 between adjacent light emitting elements and a separation s9 between adjacent groups of light emitting elements. The separation s8 of input apertures matches separation s1 and the separation s12 of adjacent groups of input apertures matches s9. Such a structure can be formed using the method of FIG. 3. In this manner, the separation of the light emitting elements and optics are matched, independent of the separation hl of apertures in the thermally conducting plate 44 of the heat dissipating structure. Advantageously such embodiment can achieve high precision alignment and high uniformity of output illumination, while reducing cost of fabrication of the heat dissipating structure. The monolithic optical element array 118 may have regions 122, 124 that can be removed after attachment so that advantageously the thermally conducting plate 44 can be attached to the substrate 36 to achieve optimum heat transfer from the light emitting elements to the heat dissipating device.

Thus a method of manufacturing an illumination apparatus comprises providing an integrated assembly comprising an optical element array 120 integrated with a heat dissipating structure 44, 46; and thermally coupling the integrated assembly 120, 44, 46 to the first surface 35 of a substrate 36 comprising a plurality of light emitting elements 12 arranged on the first surface 35 of the substrate in an array; wherein the respective light emitting elements 12 are aligned with the respective optical elements 30. In this case providing the integrated assembly comprises providing the optical element array 118 in a monolithic form; and attaching the monolithic optical element array 118 to the heat dissipating structure 44, 46.

Figure 16:
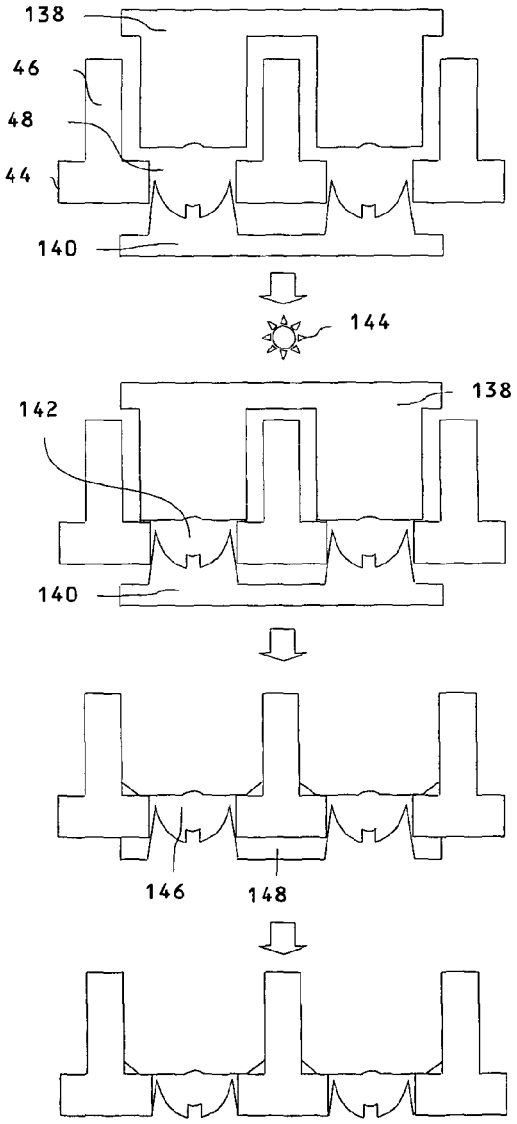
FIG. 16 shows a method to fabricate a heat dissipating structure with attached optical elements.

FIG. 16 shows a further method to form a heat dissipating structure. In a first step, a heat dissipating structure with thermally conducting plate 44 and heat dissipating fins 46 is formed with apertures 48 in the thermally conducting plate 44. Tools 138 and 140 are placed in alignment with the apertures 48. The tools may be in nickel, polydimethylsiloxane or other replication tool materials. In a second step a curable material 142 is introduced between the tools. If the material is UV curable then a UV lamp 144 is introduced to cure the material through a transparent tool 138 or 140. Alternatively, the material may be for example radiation or thermally curable. In a third step the tools are removed after cure to form the required optical array 146. However, additional material 148 may be positioned to the rear of the thermally conducting plate. In order to achieve a good thermal contact between a substrate 36 and the thermally conducting plate 44, the material 148 is removed in a fourth step, for example by cutting or peeling, to produce the optical element 30. In this case, providing the integrated assembly comprises first providing the heat dissipating structure 44, 46 and thereafter forming an optical element array 146 in-situ with the heat dissipating structure 44, 46 such that the optical element array 146 is integrated with the heating dissipating structure 44, 46 as part of the forming of the optical element array 146. The forming of the optical element array 146 comprises positioning tool parts 138, 140 in relation to the heat dissipating structure 44, 46 and using the tool parts 138, 140 to provide a moulding tool for forming the optical element array 146.

A heatsink apparatus for thermally coupling to the first surface 35 of a substrate 36 comprises a plurality of light emitting elements 12 positioned on the first surface 35 of the substrate 36 and arranged in an array may comprise an integrated assembly of an optical element 12 array with a heat dissipating structure 44, 46 wherein the optical element 12 array is arranged such that light is capable of passing through the heat dissipating structure 44, 46 by means of the optical elements 30 of the optical element array. The optical elements of the optical element array can be formed in a thermally conducting plate 44 of the heat dissipating structure. Alternatively the optical elements 30 of the optical element array are attached to a thermally conducting plate 44 of the heat dissipating structure. The heat dissipating structure of the heatsink may comprise at least one coating to provide one or more of the following characteristics: (i) light diffusion; (ii) specular reflection of light; (iii) absorption of light; (iv) dust adhesion reduction. The heat dissipating structure of the heat sink may comprise fins 46 extending away from the plane of the thermally conducting plate 44 wherein the fins are elongate, oriented with an elongate axis direction 25 parallel to the plane of the thermally conducting plate 44.

Figure 17:
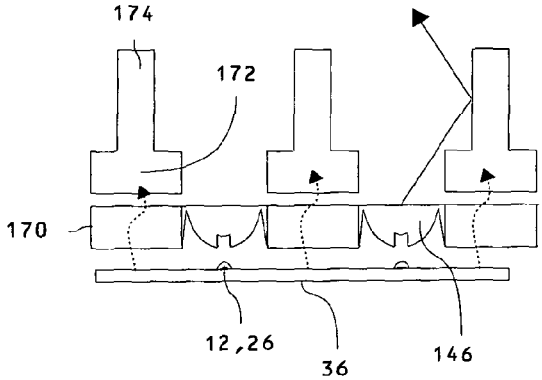
FIG. 17 shows a heat dissipating structure comprising separate heat dissipating plate and heat dissipating fin structures.

FIG. 17 shows an alternative embodiment in which the optical element 30 is formed in a thermally conducting plate 170 which is then attached to a further heat dissipating structure comprising thermally conducting plate 172 and heat dissipating fins 174. Such a method achieves an integrated assembly comprising an optical element array 146 integrated with a first heat dissipating structure 170 that is thermally coupled to a further heat dissipating structure 172, 174. Such a structure advantageously achieves the thermally conducting plate 170 to be more accessible to the tools used to form the structure as shown in FIG. 16, thus simplifying replication of the optical structure. The heat dissipating structure 172, 174 is then attached to the thermally conducting plate 170 after the optical elements 30 are formed. Alternatively the optical elements 30 in the plate 170 may be replaced by the surfaces such as elements 56 shown in FIG. 6*a*. Such an arrangement achieves more convenient formation of the structures 56. Further advantageously the thermally conducting plate 170 can be formed by precision manufacturing processes whereas the structure 172 can be formed by low precision manufacturing processes, reducing the overall cost.

Thus the optical elements 30 of the optical element array are formed in a thermally conducting plate 170 of the heat dissipating structure. Alternatively the optical elements 30 of the optical element array are attached to a thermally conducting plate 44 of the heat dissipating structure. The heat dissipating structure may comprise at least one coating to provide one or more of the following characteristics: (i) light diffusion; (ii) specular reflection of light; (iii) absorption of light; (iv) dust adhesion reduction. The heat dissipating structure may comprise fins extending away from the plane of the thermally conducting plate; wherein the fins are elongate, oriented with an axis direction parallel to the plane of the thermally conducting plate.

Figure 18:
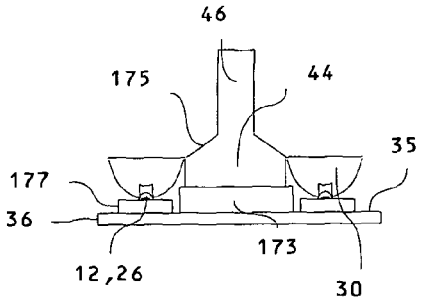
FIG. 18 shows a detail of a structure for attachment of light emitting elements and heat dissipating structures.

FIG. 18 shows a detail of one means to attach a heat dissipating structure and light emitting elements to the first surface 35 of the substrate 36. Each light emitting element 12 may comprise an additional carrier 177 which may comprise electrical contacts and may be silicon, ceramic, some composite structure and/or heat sink material. The carrier 177 is considered to form part of the light emitting element 12 and the light emitting elements are considered to be positioned on the first surface 35 of the substrate 36. The carrier 177 transfers heat from the light emitting element 12 to the substrate 36. The heat dissipating structure 44, 46 may be attached to the substrate 36 by means of a heat transfer layer 173 which may be for example a heat sink compound, or a heat transferring spacer material. Thus the heat transfer layer 173 may form part of the structure 44, 46 and is attached to the front surface 35 of the substrate 36. The heat dissipating structure 44, 46 thus remains interspersed with different light emitting elements of the array of light emitting elements and respective aligned optical elements. The thermally conducting plate 44 may have additional slanted surfaces 175 so as to effectively cooperate with the light output directional distribution from the optical element 30. Portions of the heat dissipating structure are interspersed between different optical elements of the array of optical elements.

Figure 19A:
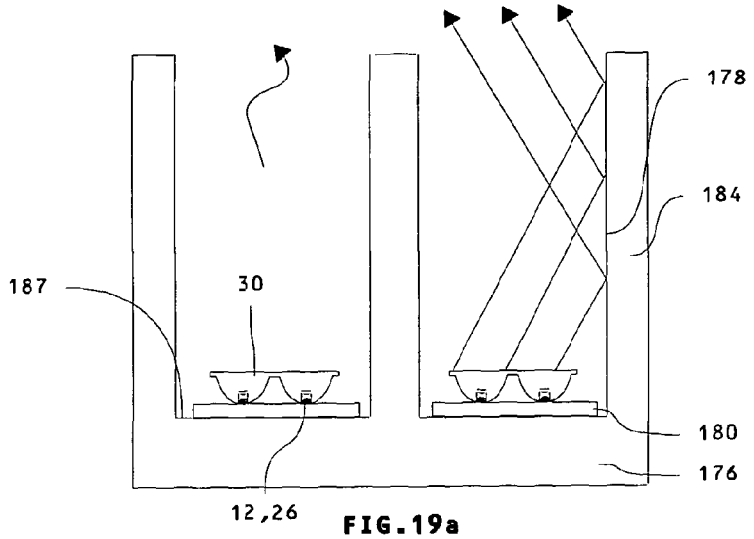
FIG. 19*a* shows a heat dissipating structure and light emitting apparatus.

FIG. 19*a* shows in side view a directional lighting apparatus. Light emitting elements 12 and ancillary optics 26 are provided in an array mounted on substrate 180 and the rear of the substrate 180 thermally coupled to the heat dissipating structure comprising a substrate-mounting plate 176 with a first surface 187 and heat dissipating elements 184. The light emitting elements 12 are aligned to an array of respective optical elements 30 to achieve a directional output. The heat dissipating elements 184 may comprise light controlling surfaces 178 which may incorporate for example absorbing, specular reflecting, or diffusing light controlling functions, for example as described with reference to FIG. 8*a*-8*d*.

Figure 19B:
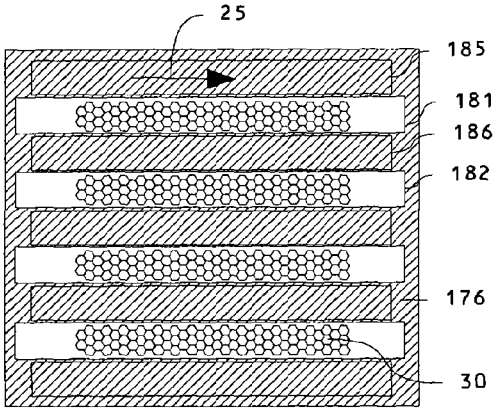
FIG. 19*b* shows an arrangement of heat dissipating structures and light emitting elements substrates.
Figure 19C:
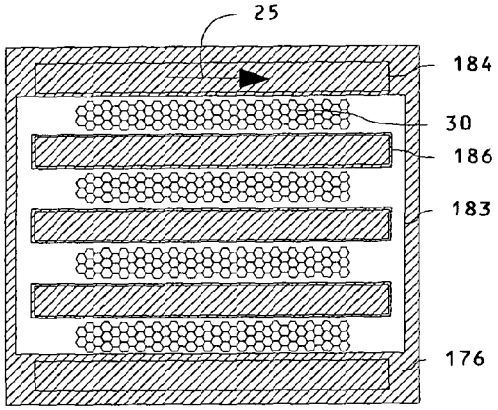
FIG. 19*c* shows a further arrangement of heat dissipating structures and light emitting elements substrates.

FIG. 19*b* shows in plan view one arrangement of optical elements 30, substrates 181, 182 and heat dissipation structure comprising adjacent elongate heat dissipating elements 185, 186 with elongate axis direction 25. The substrate 180 may be arranged in a gap between adjacent elements 185, 186. Advantageously such an arrangement reduces the overall thickness of the device and allows for convenient mounting of substrates 181, 182 without the requirement to provide light transmitting apertures (such as aperture 48 in FIG. 1) in the substrate-mounting plate 176, thus reducing cost of fabrication of the heat dissipating structure. Alternatively, as shown in FIG. 19*c*, a single substrate 183 may be used with apertures 188 through which the heat dissipating elements can protrude. Advantageously, the alignment between light emitting elements and optical elements can be maintained across the whole of the optical element 30 array, improving overall device optical output uniformity. Further, the optical element 30 array may be monolithic, across the whole of the device, or within certain regions of the device. Thus an illumination apparatus, comprises a heat dissipating structure comprising a substrate-mounting plate 176 and a plurality of heat dissipating elements 184, the plurality of heat dissipating elements 184 extending away from a first surface 187 of the substrate-mounting plate 176; and a plurality of light emitting elements 12 aligned with respective optical elements 30 and arranged on one or more substrates 180; the one or more substrates 180 being mounted on the first surface of the substrate-mounting plate 176, such that at least some of the heat dissipating elements 184 are interspersed between at least some of the light emitting elements 12.

Figure 19D:
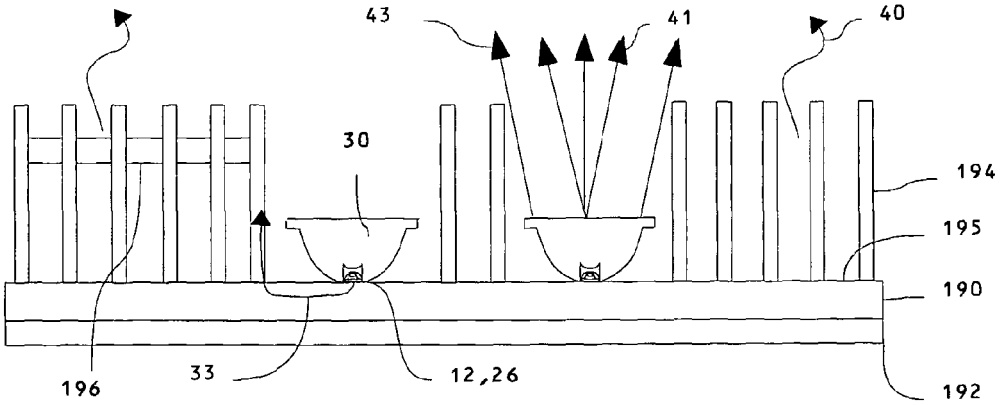
FIG. 19*d* shows a further arrangement of heat dissipating structures and light emitting elements.

FIG. 19*d* shows an illumination apparatus in which the substrate 190 for the light emitting elements also provides a thermally conducting plate. A further substrate 192 that may be thermally coupled to the substrate 190 may be provided which achieves mechanical support for the substrate 190 and may further achieve heat dissipating function. Heat dissipating elements 194 are thermally coupled to the first surface 195 of the first substrate 190. A further connecting member 196 may be incorporated in regions of the heat dissipating elements 194 to achieve mechanical support of the elements 194, and may further achieve heat dissipation. The illumination apparatus comprises a plurality of light emitting elements 12 aligned with respective optical elements 30 and arranged on a first side of a substrate 190; and a heat dissipating structure comprising a plurality of heat dissipating elements 194, the plurality of heat dissipating elements arranged on, and extending away from, the first surface 195 of the substrate 190, and thermally coupled to the light emitting elements 12 at least to an extent via the substrate 190 such that in operation heat from the light emitting elements 12 is dissipated by the heat dissipating structure; at least some of the heat dissipating elements 194 being interspersed between at least some of the light emitting elements 12. Advantageously, such an arrangement achieves the combination of light emitting element substrate and thermally conducting plate of FIG. 1. The heat dissipating elements 194 may be attached to the substrate 190 after the light emitting elements 12 and optical elements 30 have been formed to simplify assembly of the device.

Figure 20:
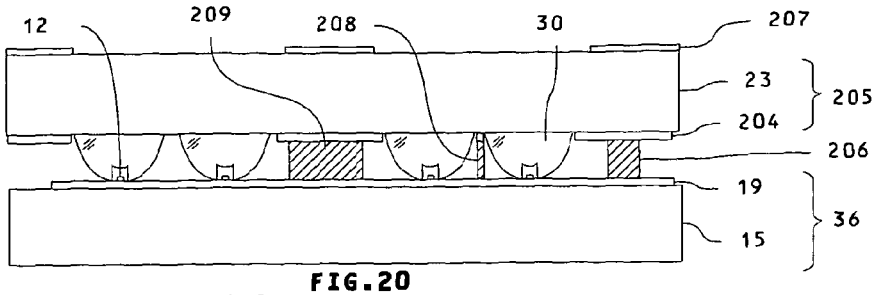
FIG. 20 shows in cross section a further arrangement of heat dissipating structure.

FIG. 20 shows an embodiment in cross section wherein an array of light emitting elements 12 is formed on substrate 36 comprising a glass layer 15 and a metallic heat spreader 19. An array of catadioptric optical elements 30 is formed on a substrate 205 comprising electrically insulating layer 23 comprising a glass layer and optionally a heat spreading layer 204. Heat dissipating elements 206, 208 and 209 are positioned on the surface of one of the substrates 36, 205 and the light emitting elements 12 and optical elements 30 are aligned by means of aligning the substrates 36, 205. Heat dissipating elements 206, 208, 209 may comprise a patterned metal or thermally conductive polymer gasket and may be bonded to the heat spreading layers 19, 204 during assembly, for example using an adhesive, solder or other known attachment means.

The thermal resistance between the light emitting elements 12 and layer 23 can be further reduced by introducing a material with a higher thermal conductivity than air into the gaps between the optical elements. For example, a thermally conductive (but not necessarily electrically conductive) epoxy can be used to fill the gaps between the optical elements 30. In this case, the optical elements 30 may be coated with a reflective layer to maintain the collimating property of the optical elements.

Figure 21A:
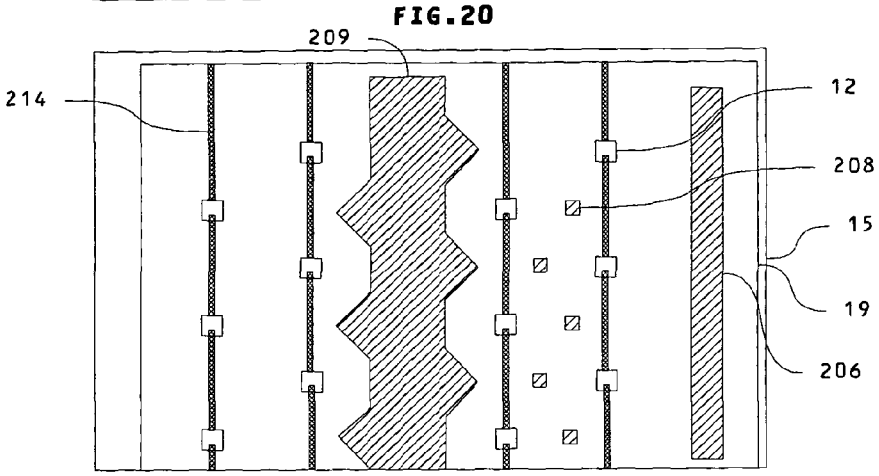
FIG. 21*a* shows in plan view the arrangement of elements on the first surface of the first substrate of FIG. 21.
Figure 21B:
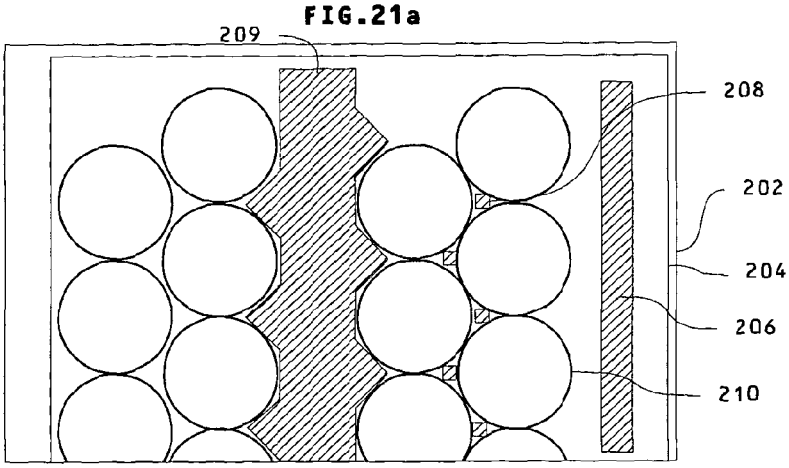
FIG. 21*b* shows in plan view the arrangement of elements on the first surface on the second substrate of FIG. 21.

FIG. 21*a* shows in plan view the first (upper) surface of the substrate 36. Light emitting elements 12 are connected in a string by means of electrodes 214. Heat dissipating elements 206, 208, 209 are arranged between columns of light emitting elements 12. FIG. 21*b* shows in plan view the first (lower) surface of the substrate 205. The exit aperture 210 of optical elements 30 are aligned with the heat dissipating elements 206, 209 such that the heat dissipating elements are arranged fill the gaps between the apertures 210. Heat dissipating element 206 is arranged to transfer heat from the layer 19 to layer 204, which is patterned to fill the gaps between the apertures 210.

The heat dissipating elements 206, 208 may be formed using a metal, thermally conductive polymer, or other thermally conductive gasket layer that may be bonded to the heat spreader layers 19, 204 during assembly of the embodiment in FIG. 20. Before assembly of substrates 205 and 36, the gasket 206, 208 may be bonded to first to either substrate. In this manner advantageously, heat may be transferred from the light emitting elements 12 to the layer 23. Further heat dissipating apparatus may be positioned on layer 23, or the layer itself may be arranged to radiate heat, for example by providing a heat radiating layer 207 between the apertures of the optical elements 30. The heat radiating layer 207 may be for example a printed black paint. Advantageously, such a layer 207 may be used to further achieve enhanced penumbra sharpness.

Figure 22:
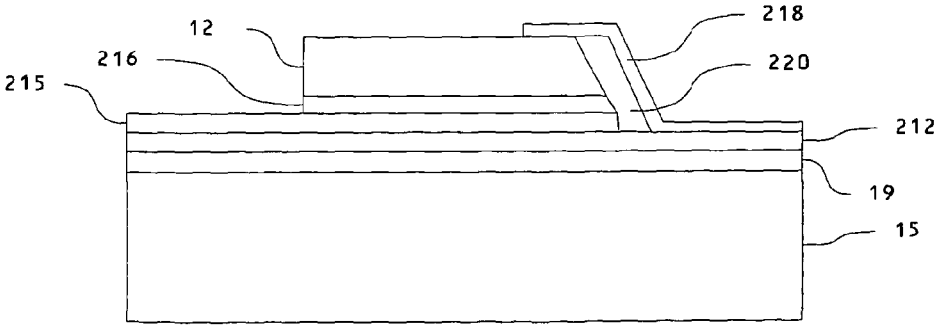
FIG. 22 shows a detail of an electrode arrangement for connection to a light emitting element.

FIG. 22 shows a detailed arrangement of electrode attachment to the light emitting element 12 in the area of the electrode 214 in FIG. 21*a*. A patterned electrically insulating layer is positioned on the surface of heat spreading layer 19, and input electrode 215 attached to the underside of light emitting element 12 by means of a layer 216. The layer 216 may comprise for example a eutectic solder such as Au—Sn or may be a nano-silver epoxy material to achieve electrical and thermal contact of the LED to the electrode 215. An insulating layer 220 is applied to the light emitting element 12 and an electrode 218 positioned in contact with the light emitting element and insulator 212. In this manner, a photolithography process can be used to provide electrical contact to a string of light emitting elements of the Vertical Thin Film (VTF) type. A similar arrangement wherein both contacts are on the bottom layer of the light emitting element can be used to provide a Thin Film Flip Chip (TFFC) type of LED chip. Advantageously, heat can be effectively transferred from the light emitting element 12 into the heat spreading layer 19 and from that into the heat dissipating elements 206, 208. Further, the electrical contact is independent of the heat spreading layer. Alternatively, the heat spreading layer can be used to provide electrical contact to the string of light emitting elements 12.

Figure 23A:
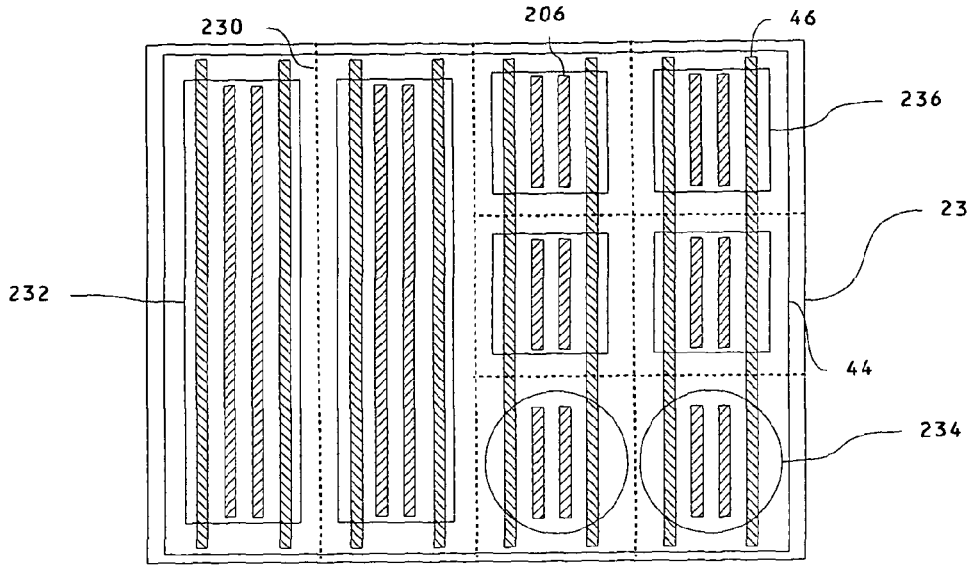
FIG. 23*a* shows in plan view a mothersheet comprising an array of heat dissipating structures.

FIG. 23*a* shows in plan view mothersheet processing of the sandwich of layers shown in FIG. 20 for example by illustrating regions of layer 23. In particular, large mothersheets can be populated with light emitting elements 12, optical elements 30, heat dissipating elements 206, 208. After processing and assembly of the elements on the mothersheet in parallel, suitable sized regions can be extracted by cutting or scribe and break along lines 230 to suit the particular application. For example region 232 may be used for a fluorescent lamp replacement while regions 234 and 236 may be used for different form factor halogen lamp replacements.

The mothersheet processing embodiments thus have advantages of enabling large numbers of light emitting elements to be processed in parallel, thus removing substantial cost when compared to chip at a time pick-and-place techniques. In addition to light emitting element 12 and optical element 26, 30 processing, electrical connection and heat dissipating elements 206, 208, 44, 46 can further be processed in large sheets prior to cutting down of complete assemblies, further reducing cost and enabling a single alignment for a large number of lamps. The cost is reduced and quality of alignment is increased, improving overall device uniformity.

The internal heat dissipating elements 204, 206 advantageously achieve a heat conduction path through electrical insulating layers 15, 23 which may typically be glass. Thus the heat dissipation of the assembly is advantageously achieved through both front and rear substrates, enabling the junction temperatures of the array of light emitting elements to be reduced, and increasing uniformity. Further heat dissipating elements can be applied to the rear of the substrate 36 to achieve enhanced heat dissipation.

Figure 23B:
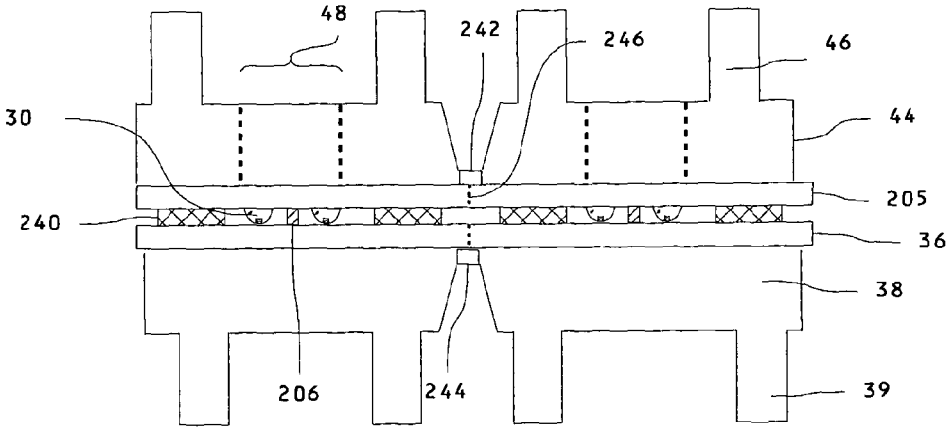
FIG. 23*b* shows in cross section a mothersheet comprising an array of heat dissipating structures.

Further, heat dissipating elements 44, 46 may be attached to the mothersheets prior to extraction of the elements. If the heat dissipating elements are formed in thermally conductive plastics then a single large area heatsink can be attached to the mothersheet and cut prior to extraction of the regions 232, 234, 236. FIG. 23*b* shows in cross section one arrangement of mothersheet processing of the heat dissipating structures similar to that shown in FIG. 23*a*. Plate 44 is provided with regions in which sacrificial elements 242 are provided. Similarly plate 38 may be provided with sacrificial elements 244. During assembly, a single heat dissipating structure is positioned on one or both of the surfaces of substrates 36, 205 so that a single alignment step is achieved across the whole of the mothersheet. After the alignment step, elements 242, 244 are removed, for example by laser cutting, or peeling perforated elements so as to separate respective regions of the heat dissipating elements aligned with regions of light emitting elements 12 and optical elements 30. A subsequent step provides a scribe at position 246 for each substrate so that the mothersheet may be singulated. Advantageously, such an arrangement reduces the cost of the alignment of heat dissipating structures with the optical elements and thus reduces assembly cost.

Figure 24:
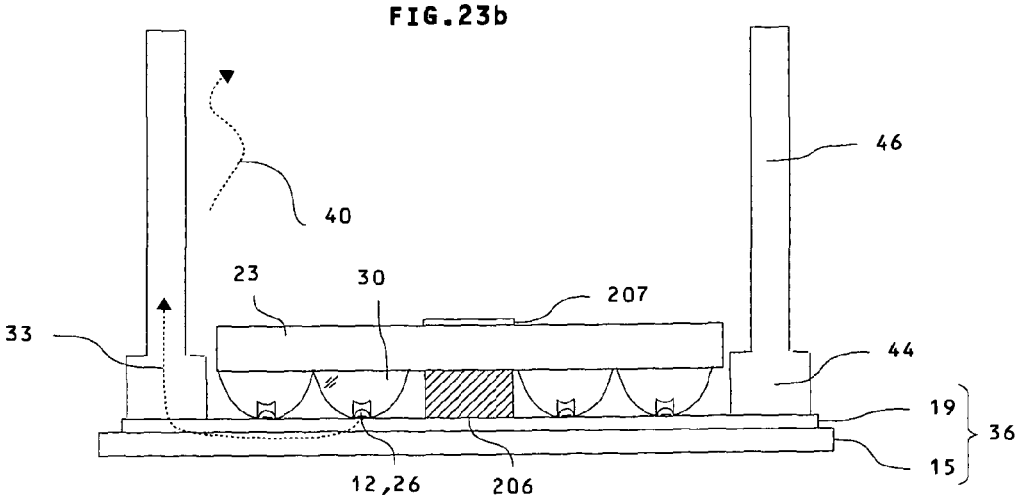
FIG. 24 shows in cross section a further arrangement of heat dissipating structures.

FIG. 24 shows a further embodiment wherein the heat dissipating structure 44, 46 is positioned on the substrate 36 and the heat dissipating element 206 is provided to achieve thermal conduction to the layer 23. A heat radiating element 207 is positioned on the front surface of the layer 23 so as to provide some heat dissipation function. Advantageously such an arrangement achieves front and rear heat dissipation as well as increased dissipation from the layer 23.

The invention claimed is:

1. An illumination apparatus, comprising:

a plurality of light emitting elements positioned on a first surface of a substrate and arranged in an array;

a plurality of catadioptric optical elements that are arranged in an array, the array of catadioptric optical elements being aligned with the array of light emitting elements such that individual optical elements are aligned with respective individual light emitting elements;

a heat dissipating structure positioned on the first surface of the substrate;

the heat dissipating structure thermally coupled to the light emitting elements at least to an extent via the substrate such that in operation heat from the light emitting elements is dissipated by the heat dissipating structure;

wherein at least some different portions of the heat dissipating structure are interspersed between at least some different light emitting elements of the array of light emitting elements;

wherein the heat dissipating structure comprises a thermally conducting plate that is thermally coupled to the first surface of the substrate.

2. An illumination apparatus according to claim 1 wherein the different portions of the heat dissipating structure being interspersed between different light emitting elements of the array of light emitting elements contributes to the control of the light output directional distribution.

3. An illumination apparatus according to claim 1 wherein the substrate comprises a thermally conductive heat spreading layer at the first surface wherein the thermally conductive heat spreading layer is positioned on an electrically insulating layer.

4. An illumination apparatus according to claim 1, wherein each catadioptric optical element has an output aperture of maximum width or diameter less than or equal to 7 mm;

wherein each light-emitting element has a maximum width or diameter less than or equal to 300 micrometers;

wherein each catadioptric optical element has a maximum height of less than or equal to 5 mm.

5. An illumination apparatus according to claim 1 wherein the combined thickness of a light emitting element with an aligned catadioptric optical element is greater or equal to a third of the thickness of the thermally conducting plate and less than or equal to three times the thickness of the thermally conducting plate.

6. An illumination apparatus according to claim 5 wherein the combined thickness of a light emitting element with an aligned catadioptric optical element is approximately equal to the thickness of the thermally conducting plate.

7. An illumination apparatus according to claim 1 wherein the heat dissipating structure comprises a plurality of fins extending away from the plane of the substrate.

8. An illumination apparatus according to claim 1 wherein the different portions of the heat dissipating structure being interspersed between different light emitting elements of the array of light emitting elements comprises the light emitting elements and catadioptric optical elements being located within gaps of the heat dissipating structure that extend through the whole thickness of the heat dissipating structure.

9. An illumination apparatus according to claim 1 wherein the array of catadioptric optical elements is attached to the heat dissipating structure.

10. An illumination apparatus according to claim 1 wherein fins of the heat dissipating structure are reflective.

11. An illumination apparatus according to claim 1 wherein a two-dimensional array of light emitting elements is positioned between adjacent fins of the heat dissipating structure.

12. An illumination apparatus according to claim 1 wherein the surface profile of a fin of the heat dissipating structure is shaped other than parallel planar so as to contribute to the control of the light output directional distribution in cooperation with the array of light emitting elements and respective aligned array of catadioptric optical elements.

13. An illumination apparatus according to claim 1 further comprising a second heat dissipating structure thermally coupled to the light emitting elements, the second heat dissipating structure positioned to the opposite side of the substrate as the light emitting elements and the first heat dissipating structure.

14. An illumination apparatus according to claim 13, wherein the proportion of the heat being dissipated from the light emitting elements by the first heat dissipating structure compared to the second heat dissipating structure is adjustable.

15. An illumination apparatus according to claim 1 wherein different parts of the surface of each fin of the heat dissipating structure have different coatings wherein the different coatings respectively provide one or more of the following characteristics: diffusion; specular reflection; or absorption.

16. An illumination apparatus according to claim 1 wherein the light controlling parts of the heat dissipating structure have tapered sides wherein the sides are tapered such that the output cone angle from the fins is greater than the output cone angle from the array of light emitting elements and respective aligned array of catadioptric optical elements.

17. An illumination apparatus according to claim 1 wherein the different portions of the heat dissipating structure being interspersed between different light emitting elements of the array of light emitting elements comprises elongate fins oriented with an axis direction parallel to the plane of the first surface wherein the heat dissipating structure comprises at least two different orientations of elongate fins.

18. A method of manufacturing an illumination apparatus according to claim 1, the method comprising:

providing an integrated assembly comprising a catadioptric optical element array integrated with a heat dissipating structure; and thermally coupling the integrated assembly to the first surface of a substrate comprising a plurality of light emitting elements arranged on the first surface of the substrate in an array;

wherein the respective individual light emitting elements are aligned with the respective individual catadioptric optical elements.

* * * * *